US009050647B2

(12) United States Patent
Thomas et al.

(10) Patent No.: US 9,050,647 B2
(45) Date of Patent: Jun. 9, 2015

(54) SPLIT-PASS OPEN-DIE FORGING FOR HARD-TO-FORGE, STRAIN-PATH SENSITIVE TITANIUM-BASE AND NICKEL-BASE ALLOYS

(71) Applicant: ATI Properties, Inc., Albany, OR (US)

(72) Inventors: Jean-Phillipe A. Thomas, Charlotte, NC (US); Ramesh S. Minisandram, Charlotte, NC (US); Jason P. Floder, Gastonia, NC (US); George J. Smith, Jr., Wingate, NC (US)

(73) Assignee: ATI Properties, Inc., Albany, OR (US)

( * ) Notice: Subject to any disclaimer, the term of this patent is extended or adjusted under 35 U.S.C. 154(b) by 162 days.

(21) Appl. No.: 13/844,545

(22) Filed: Mar. 15, 2013

(65) Prior Publication Data

US 2014/0260492 A1 Sep. 18, 2014

(51) Int. Cl.

| | |
|---|---|
| ***B21D 37/16*** | (2006.01) |
| ***B21J 1/06*** | (2006.01) |
| ***B21J 1/02*** | (2006.01) |
| ***C22F 1/10*** | (2006.01) |

(Continued)

(52) U.S. Cl.

CPC .. *B21J 1/06* (2013.01); *B21J 1/025* (2013.01); *C22F 1/10* (2013.01); *C22F 1/183* (2013.01); *C21D 7/13* (2013.01)

(58) Field of Classification Search

CPC ..... B21J 1/06; B21J 1/025; C21D 7/10; C22F 1/10; C22F 1/183

USPC ..... 72/115, 220, 342.1, 342.5, 342.6, 377, 72/379.2

See application file for complete search history.

(56) References Cited

U.S. PATENT DOCUMENTS

| | | | |
|---|---|---|---|
| 2,857,269 | A | 10/1958 | Vordahl |
| 2,932,886 | A | 4/1960 | Althouse |

(Continued)

FOREIGN PATENT DOCUMENTS

| | | | |
|---|---|---|---|
| CN | 1070230 | A | 3/1993 |
| CN | 1194671 | A | 9/1998 |

(Continued)

OTHER PUBLICATIONS

"Allvac TiOsteum and TiOstalloy Beat Titanium Alloys", printed from www.allvac.com/allvac/pages/Titanium/TiOsteum.htm on Nov. 7, 2005.

(Continued)

*Primary Examiner* — David B Jones

(74) *Attorney, Agent, or Firm* — K & L Gates LLP; John E. Grosselin, III

(57) ABSTRACT

Split pass forging a workpiece to initiate microstructure refinement comprises press forging a metallic material workpiece in a first forging direction one or more times up to a reduction ductility limit of the metallic material to impart a total strain in the first forging direction sufficient to initiate microstructure refinement; rotating the workpiece; open die press forging the workpiece in a second forging direction one or more times up to the reduction ductility limit to impart a total strain in the second forging direction to initiate microstructure refinement; and repeating rotating and open die press forging in a third and, optionally, one or more additional directions until a total amount of strain to initiate microstructure refinement is imparted in an entire volume of the workpiece.

22 Claims, 7 Drawing Sheets

(51) Int. Cl.
*C22F 1/18* (2006.01)
*C21D 7/13* (2006.01)

(56) References Cited

U.S. PATENT DOCUMENTS 3,015,292 A 1/1962 Bridwell
3,025,905 A 3/1962 Haerr
3,060,564 A 10/1962 Corral
3,313,138 A 4/1967 Spring et al.
3,379,522 A 4/1968 Vordahl
3,489,617 A 1/1970 Wuerfel
3,584,487 A 6/1971 Carlson
3,605,477 A 9/1971 Carlson
3,615,378 A 10/1971 Bomberger, Jr. et al.
3,635,068 A 1/1972 Watmough et al.
3,686,041 A 8/1972 Lee
3,815,395 A 6/1974 Sass
3,922,899 A 12/1975 Fremont et al.
3,979,815 A 9/1976 Nakanose et al.
4,053,330 A 10/1977 Henricks et al.
4,067,734 A 1/1978 Curtis et al.
4,094,708 A 6/1978 Hubbard et al.
4,098,623 A 7/1978 Ibaraki et al.
4,120,187 A 10/1978 Mullen
4,147,639 A 4/1979 Lee et al.
4,150,279 A 4/1979 Metcalfe et al.
4,163,380 A 8/1979 Masoner
4,197,643 A 4/1980 Burstone et al.
4,229,216 A 10/1980 Paton et al.
4,309,226 A 1/1982 Chen
4,472,207 A 9/1984 Kinoshita et al.
4,482,398 A 11/1984 Eylon et al.
4,543,132 A 9/1985 Berczik et al.
4,631,092 A 12/1986 Ruckle et al.
4,639,281 A 1/1987 Sastry et al.
4,668,290 A 5/1987 Wang et al.
4,687,290 A 8/1987 Prussas
4,688,290 A 8/1987 Hogg
4,690,716 A 9/1987 Sabol et al.
4,714,468 A 12/1987 Wang et al.
4,799,975 A 1/1989 Ouchi et al.
4,808,249 A 2/1989 Eyelon et al.
4,842,653 A 6/1989 Wirth et al.
4,851,055 A 7/1989 Eylon et al.
4,854,977 A 8/1989 Alheritiere et al.
4,857,269 A 8/1989 Wang et al.
4,878,966 A 11/1989 Alheritiere et al.
4,888,973 A 12/1989 Comley
4,889,170 A 12/1989 Mae et al.
4,919,728 A 4/1990 Kohl et al.
4,943,412 A 7/1990 Bania et al.
4,975,125 A 12/1990 Chakrabarti et al.
4,980,127 A 12/1990 Parris et al.
5,026,520 A 6/1991 Bhowal et al.
5,032,189 A 7/1991 Eylon et al.
5,041,262 A 8/1991 Gigliotti, Jr.
5,074,907 A 12/1991 Amato et al.
5,080,727 A 1/1992 Aihara et al.
5,141,566 A 8/1992 Kitayama et al.
5,156,807 A 10/1992 Nagata et al.
5,162,159 A 11/1992 Tenhover et al.
5,169,597 A 12/1992 Davidson et al.
5,173,134 A 12/1992 Chakrabarti et al.
5,201,457 A 4/1993 Kitayama et al.
5,244,517 A 9/1993 Kimura et al.
5,264,055 A 11/1993 Champin et al.
5,277,718 A 1/1994 Paxson et al.
5,310,522 A 5/1994 Culling
5,332,454 A 7/1994 Meredith et al.
5,332,545 A 7/1994 Love
5,342,458 A 8/1994 Adams et al.
5,358,586 A 10/1994 Schutz
5,359,872 A 11/1994 Nashiki
5,360,496 A 11/1994 Kuhlman et al.
5,442,847 A 8/1995 Semiatin et al.
5,472,526 A 12/1995 Gigliotti, Jr.
5,494,636 A 2/1996 Dupioron et al.
5,509,979 A 4/1996 Kimura
5,516,375 A 5/1996 Ogawa et al.
5,520,879 A 5/1996 Saito et al.
5,545,262 A 8/1996 Hardee et al.
5,545,268 A 8/1996 Yashiki et al.
5,558,728 A 9/1996 Kobayashi et al.
5,580,665 A 12/1996 Taguchi et al.
5,600,989 A 2/1997 Segal et al.
5,649,280 A 7/1997 Blankenship et al.
5,658,403 A 8/1997 Kimura
5,662,745 A 9/1997 Takayama et al.
5,679,183 A 10/1997 Takagi et al.
5,698,050 A 12/1997 El-Soudani
5,758,420 A 6/1998 Schmidt et al.
5,759,484 A 6/1998 Kashii et al.
5,795,413 A 8/1998 Gorman
5,871,595 A 2/1999 Ahmed et al.
5,896,643 A * 4/1999 Tanaka ..... 72/462
5,897,830 A 4/1999 Abkowitz et al.
5,954,724 A 9/1999 Davidson
5,980,655 A 11/1999 Kosaka
6,002,118 A 12/1999 Kawano et al.
6,053,993 A 4/2000 Reichman et al.
6,071,360 A 6/2000 Gillespie
6,077,369 A 6/2000 Kusano et al.
6,127,044 A 10/2000 Yamamoto et al.
6,132,526 A 10/2000 Carisey et al.
6,139,659 A 10/2000 Takahashi et al.
6,143,241 A 11/2000 Hajaligol et al.
6,187,045 B1 2/2001 Fehring et al.
6,197,129 B1 3/2001 Zhu et al.
6,200,685 B1 3/2001 Davidson
6,209,379 B1 4/2001 Nishida et al.
6,216,508 B1 * 4/2001 Matsubara et al. ..... 72/379.2
6,228,189 B1 5/2001 Oyama et al.
6,250,812 B1 6/2001 Ueda et al.
6,258,182 B1 7/2001 Schetky et al.
6,284,071 B1 9/2001 Suzuki et al.
6,332,935 B1 12/2001 Gorman et al.
6,334,350 B1 1/2002 Shin et al.
6,384,388 B1 5/2002 Anderson et al.
6,387,197 B1 5/2002 Bewlay et al.
6,391,128 B2 5/2002 Ueda et al.
6,399,215 B1 6/2002 Zhu et al.
6,402,859 B1 6/2002 Ishii et al.
6,409,852 B1 6/2002 Lin et al.
6,532,786 B1 * 3/2003 Luttgeharm ..... 72/379.2
6,536,110 B2 3/2003 Smith et al.
6,539,607 B1 4/2003 Fehring et al.
6,539,765 B2 4/2003 Gates
6,558,273 B2 5/2003 Kobayashi et al.
6,561,002 B2 * 5/2003 Okada et al. ..... 72/379.2
6,569,270 B2 5/2003 Segal
6,632,304 B2 10/2003 Oyama et al.
6,663,501 B2 12/2003 Chen
6,726,784 B2 4/2004 Oyama et al.
6,742,239 B2 6/2004 Lee et al.
6,764,647 B2 7/2004 Aigner et al.
6,773,520 B1 8/2004 Fehring et al.
6,786,985 B2 9/2004 Kosaka et al.
6,800,153 B2 10/2004 Ishii et al.
6,908,517 B2 6/2005 Segal et al.
6,918,971 B2 7/2005 Fujii et al.
6,932,877 B2 8/2005 Raymond et al.
6,971,256 B2 * 12/2005 Okada et al. ..... 72/342.1
7,032,426 B2 4/2006 Durney et al.
7,037,389 B2 5/2006 Barbier et al.
7,038,426 B2 5/2006 Hill
7,096,596 B2 8/2006 Hernandez, Jr. et al.
7,132,021 B2 11/2006 Kuroda et al.
7,152,449 B2 12/2006 Durney et al.
7,264,682 B2 9/2007 Chandran
7,269,986 B2 9/2007 Pfaffmann et al.
7,332,043 B2 2/2008 Tetyukhin et al.
7,410,610 B2 8/2008 Woodfield et al.
7,438,849 B2 10/2008 Kuramoto et al.
7,449,075 B2 11/2008 Woodfield et al.

(56) References Cited

U.S. PATENT DOCUMENTS

| | | | | |
|---|---|---|---|---|
| 7,559,221 | B2 * | 7/2009 | Horita et al. | 72/342.6 |
| 7,611,592 | B2 | 11/2009 | Davis et al. | |
| 7,837,812 | B2 | 11/2010 | Marquardt et al. | |
| 7,879,286 | B2 | 2/2011 | Miracle et al. | |
| 7,984,635 | B2 | 7/2011 | Callebaut et al. | |
| 8,037,730 | B2 | 10/2011 | Polen et al. | |
| 8,048,240 | B2 | 11/2011 | Hebda et al. | |
| 8,316,687 | B2 * | 11/2012 | Slattery | 72/476 |
| 8,336,359 | B2 | 12/2012 | Werz | |
| 8,408,039 | B2 * | 4/2013 | Cao et al. | 72/418 |
| 8,499,605 | B2 | 8/2013 | Bryan | |
| 8,578,748 | B2 * | 11/2013 | Huskamp et al. | 72/200 |
| 2003/0154757 | A1 * | 8/2003 | Fukuda et al. | 72/214 |
| 2003/0168138 | A1 | 9/2003 | Marquardt | |
| 2004/0099350 | A1 | 5/2004 | Mantione et al. | |
| 2004/0148997 | A1 * | 8/2004 | Amino et al. | 72/297 |
| 2004/0221929 | A1 | 11/2004 | Hebda et al. | |
| 2004/0250932 | A1 | 12/2004 | Briggs | |
| 2005/0145310 | A1 | 7/2005 | Bewlay et al. | |
| 2006/0243356 | A1 | 11/2006 | Oikawa et al. | |
| 2006/0272378 | A1 * | 12/2006 | Amino et al. | 72/305 |
| 2007/0017273 | A1 | 1/2007 | Haug et al. | |
| 2007/0193662 | A1 | 8/2007 | Jablokov et al. | |
| 2007/0286761 | A1 | 12/2007 | Miracle et al. | |
| 2008/0107559 | A1 | 5/2008 | Nishiyama et al. | |
| 2008/0202189 | A1 | 8/2008 | Otaki | |
| 2008/0210345 | A1 | 9/2008 | Tetyukhin et al. | |
| 2008/0264932 | A1 | 10/2008 | Hirota | |
| 2009/0183804 | A1 | 7/2009 | Zhao et al. | |
| 2009/0234385 | A1 | 9/2009 | Cichocki et al. | |
| 2010/0307647 | A1 | 12/2010 | Marquardt et al. | |
| 2011/0036139 | A1 * | 2/2011 | Slattery | 72/343 |
| 2011/0038751 | A1 | 2/2011 | Marquardt et al. | |
| 2011/0180188 | A1 | 7/2011 | Bryan et al. | |
| 2012/0003118 | A1 | 1/2012 | Hebda et al. | |
| 2012/0012233 | A1 | 1/2012 | Bryan | |
| 2012/0060981 | A1 | 3/2012 | Forbes Jones et al. | |
| 2012/0067100 | A1 | 3/2012 | Stefansson et al. | |
| 2012/0076611 | A1 | 3/2012 | Bryan | |
| 2012/0076612 | A1 | 3/2012 | Bryan | |
| 2012/0076686 | A1 | 3/2012 | Bryan | |
| 2012/0177532 | A1 | 7/2012 | Hebda et al. | |
| 2012/0308428 | A1 | 12/2012 | Forbes Jones et al. | |
| 2013/0062003 | A1 | 3/2013 | Shulkin et al. | |
| 2013/0118653 | A1 | 5/2013 | Bryan et al. | |
| 2013/0291616 | A1 | 11/2013 | Bryan | |
| 2014/0060138 | A1 | 3/2014 | Hebda et al. | |
| 2014/0076468 | A1 | 3/2014 | Marquardt et al. | |
| 2014/0076471 | A1 | 3/2014 | Forbes Jones et al. | |
| 2014/0116582 | A1 | 5/2014 | Forbes Jones et al. | |

FOREIGN PATENT DOCUMENTS

| | | | |
|---|---|---|---|
| CN | 1403622 | | 3/2003 |
| CN | 1816641 | A | 8/2006 |
| CN | 101104898 | A | 1/2008 |
| CN | 101637789 | B | 6/2011 |
| CN | 102212716 | A | 10/2011 |
| DE | 10128199 | A1 | 12/2002 |
| DE | 102010009185 | A1 | 11/2011 |
| EP | 0066361 | A2 | 12/1982 |
| EP | 0109350 | A2 | 5/1984 |
| EP | 0320820 | A1 | 6/1989 |
| EP | 0535817 | B1 | 4/1995 |
| EP | 0611831 | B1 | 1/1997 |
| EP | 0834580 | A1 | 4/1998 |
| EP | 0870845 | A1 | 10/1998 |
| EP | 0707085 | B1 | 1/1999 |
| EP | 0683242 | B1 | 5/1999 |
| EP | 0969109 | A1 | 1/2000 |
| EP | 1083243 | A2 | 3/2001 |
| EP | 1136582 | A1 | 9/2001 |
| EP | 1302554 | A1 | 4/2003 |
| EP | 1302555 | A1 | 4/2003 |
| EP | 1471158 | A1 | 10/2004 |
| EP | 1605073 | A1 | 12/2005 |
| EP | 1612289 | A2 | 1/2006 |
| EP | 1882752 | A2 | 1/2008 |
| EP | 2028435 | A1 | 2/2009 |
| EP | 2281908 | A1 | 2/2011 |
| EP | 1546429 | B1 | 6/2012 |
| GB | 847103 | | 9/1960 |
| GB | 1170997 | A | 11/1969 |
| GB | 1433306 | | 4/1976 |
| GB | 2151260 | A | 7/1985 |
| GB | 2337762 | A | 12/1999 |
| JP | 55-113865 | A | 9/1980 |
| JP | 57-62820 | A | 4/1982 |
| JP | 57-62846 | A | 4/1982 |
| JP | 60-046358 | | 3/1985 |
| JP | 60-100655 | A | 6/1985 |
| JP | 62-109956 | A | 5/1987 |
| JP | 1-279736 | A | 11/1989 |
| JP | 2-205661 | A | 8/1990 |
| JP | 3-134124 | A | 6/1991 |
| JP | 4-74856 | A | 3/1992 |
| JP | 5-117791 | A | 5/1993 |
| JP | 5-195175 | A | 8/1993 |
| JP | 8-300044 | A | 11/1996 |
| JP | 9-194969 | A | 7/1997 |
| JP | 9-215786 | A | 8/1997 |
| JP | H10-306335 | A | 11/1998 |
| JP | 11-343528 | A | 12/1999 |
| JP | 11-343548 | A | 12/1999 |
| JP | 2000-153372 | A | 6/2000 |
| JP | 2003-55749 | A | 2/2003 |
| JP | 2003-74566 | A | 3/2003 |
| JP | 2003-334633 | A | 11/2003 |
| JP | 2009-299110 | A | 12/2009 |
| JP | 2009-299120 | A | 12/2009 |
| KR | 10-2005-0087765 | A | 8/2005 |
| RU | 2197555 | C1 | 1/1977 |
| RU | 2172359 | C1 | 8/2001 |
| SU | 534518 | A1 | 1/1977 |
| SU | 631234 | A | 11/1978 |
| SU | 1088397 | A1 | 2/1991 |
| WO | WO 98/17386 | A1 | 4/1998 |
| WO | WO 98/17836 | A1 | 4/1998 |
| WO | WO 98/22629 | A | 5/1998 |
| WO | WO 02/36847 | A2 | 5/2002 |
| WO | WO 02/090607 | A1 | 11/2002 |
| WO | WO 2004/101838 | A1 | 11/2004 |
| WO | WO 2008/017257 | A1 | 2/2008 |
| WO | WO 2012/063504 | A1 | 5/2012 |
| WO | WO 2012/147742 | A1 | 11/2012 |

OTHER PUBLICATIONS

"Datasheet: Timetal 21S", Alloy Digest, Advanced Materials and Processes (Sep. 1998), pp. 38-39.

"Heat Treating of Nonferrous Alloys: Heat Treating of Titanium and Titanium Alloys," Metals Handbook, ASM Handbooks Online (2002).

"Stryker Orthopaedics TMZF® Alloy (UNS R58120)", printed from www.allvac.com/allvac/pages/Titanium/UNSR58120.htm on Nov. 7, 2005.

"Technical Data Sheet: Allvac® Ti—15Mo Beta Titanium Alloy" (dated Jun. 16, 2004).

"ASTM Designation F1801-97 Standard Practice for Corrosion Fatigue Testing of Metallic Implant Materials" ASTM International (1997) pp. 876-880.

"ASTM Designation F2066-01 Standard Specification for Wrought Titanium-15 Molybdenum Alloy for Surgical Implant Applications (UNS R58150)," ASTM International (2000) pp. 1-4.

AL-6XN® Alloy (UNS N08367) Allegheny Ludlum Corporation, 2002, 56 pages.

Allegheny Ludlum, "High Performance Metals for Industry, High Strength, High Temperature, and Corrosion-Resistant Alloys", (2000) pp. 1-8.

Allvac, Product Specification for "Allvac Ti—15 Mo," available at http://www.allvac.com/allvac/pages/Titanium/Ti15MO.htm, last visited Jun. 9, 2003 p. 1 of 1.

(56) References Cited

OTHER PUBLICATIONS

Altemp® A286 Iron-Base Superalloy (UNS Designation S66286) Allegheny Ludlum Technical Data Sheet Blue Sheet, 1998, 8 pages.
ASM Materials Engineering Dictionary, J.R. Davis Ed., ASM International, Materials Park, OH (1992) p. 39.
ATI Datalloy 2 Alloy, Technical Data Sheet, ATI Allvac, Monroe, NC, SS-844, Version1, Sep. 17, 2010, 8 pages.
ATI 690 (UNS N06690) Nickel-Base, ATI Allvac, Oct. 5, 2010, 1 page.
Isothermal forging definition, ASM Materials Engineering Dictionary, J.R. Davis ed., Fifth Printing, Jan. 2006, ASM International, p. 238.
Isothermal forging, printed from http://thelibraryofmanufacturing.com/isothermal_forging.html, accessed Jun. 5, 2013, 3 pages.
Adiabatic definition, ASM Materials Engineering Dictionary, J.R. Davis ed., Fifth Printing, Jan. 2006, ASM International, p. 9.
Adiabatic process—Wikipedia, the free encyclopedia, printed from http://en.wikipedia.org/wiki/Adiabatic_process, accessed May 21, 2013, 10 pages.
ASTM Designation F 2066-01, "Standard Specification for Wrought Titanium—15 Molybdenum Alloy for Surgical Implant Applications (UNS R58150)", May 2001, 7 pages.
ATI 6-2-4-2™ Alloy Technical Data Sheet, Version 1, Feb. 26, 2012, 4 pages.
ATI 6-2-4-6™ Titanium Alloy Data Sheet, accessed Jun. 26, 2012.
ATI 425, High-Strength Titanium Alloy, Alloy Digest, ASM International, Jul. 2004, 2 pages.
ATI 4250 Alloy Applications, retrieved from http://web.archive.org/web/20100704044024/http://www.alleghenytechnologies.com/ATI425/applications/default.asp#other, Jul. 4, 2010, Way Back Machine, 2 pages.
ATI 4250 Alloy, Technical Data Sheet, retrieved from http://web.archive.org/web/20100703120218/http://www.alleghenytechnologies.com/ATI425/specifications/datasheet.asp, Jul. 3, 2010, Way Back Machine, 5 pages.
ATI 425®-MIL Alloy, Technical Data Sheet, Version 1, May 28, 2010, pp. 1-5.
ATI 425®-MIL Alloy, Technical Data Sheet, Version 2, Aug. 16, 2010, 5 pages.
ATI 425®-MIL Titanium Alloy, Mission Critical Metallics®, Version 3, Sep. 10, 2009, pp. 1-4.
ATI 425® Titanium Alloy, Grade 38 Technical Data Sheet, Version 1, Feb. 1, 2012, pp. 1-6.
ATI 500-MIL™, Mission Critical Metallics®, High Hard Specialty Steel Armor, Version 4, Sep. 10, 2009, pp. 1-4.
ATI 600-MIL®, Preliminary Draft Data Sheet, Ultra High Hard Specialty Steel Armor, Version 4, Aug. 10, 2010, pp. 1-3.
ATI 600-MIL™, Preliminary Draft Data Sheet, Ultra High Hard Specialty Steel Armor, Version 3, Sep. 10, 2009, pp. 1-3.
ATI Aerospace Materials Development, Mission Critical Metallics, Apr. 30, 2008, 17 pages.
ATI Ti—15Mo Beta Titanium Alloy Technical Data Sheet, ATI Allvac, Monroe, NC, Mar. 21, 2008, 3 pages.
ATI Titanium 6Al—2Sn—4Zr—2Mo Alloy, Technical Data Sheet, Version 1, Sep. 17, 2010, pp. 1-3.
ATI Titanium 6Al—4V Alloy, Mission Critical Metallics®, Technical Data Sheet, Version 1, Apr. 22, 2010, pp. 1-3.
ATI Wah Chang, ATI™ 425 Titanium Alloy (Ti—4Al—2.5V—1.5Fe—0.2502), Technical Data Sheet, 2004, pp. 1-5.
ATI Wah Chang, Titanium and Titanium Alloys, Technical Data Sheet, 2003, pp. 1-16.
Beal et al., "Forming of Titanium and Titanium Alloys-Cold Forming", ASM Handbook, 2006, ASM International, vol. 14B, 2 pages.
Bewlay, et al., "Superplastic roll forming of Ti alloys", Materials and Design, 21, 2000, pp. 287-295.
Bowen, A. W., "Omega Phase Embrittlement in Aged Ti—15%Mo," Scripta Metallurgica, vol. 5, No. 8 (1971) pp. 709-715.
Bowen, A. W., "On the Strengthening of a Metastable b-Titanium Alloy by w- and a-Precipitation" Royal Aircraft Establishment Technical Memorandum Mat 338, (1980) pp. 1-15 and Figs 1-5.
Boyer, Rodney R., "Introduction and Overview of Titanium and Titanium Alloys: Applications," Metals Handbook, ASM Handbooks Online (2002).
Cain, Patrick, "Warm forming aluminum magnesium components; How it can optimize formability, reduce springback", Aug. 1, 2009, from http://www.thefabricator.com/article/presstechnology/warm-forming-aluminum-magnesium-components, 3 pages.
Callister, Jr., William D., Materials Science and Engineering, An Introduction, Sixth Edition, John Wiley & Sons, pp. 180-184 (2003).
Desrayaud et al., "A novel high straining process for bulk materials—The development of a multipass forging system by compression along three axes", Journal of Materials Processing Technology, 172, 2006, pp. 152-158.
DiDomizio, et al., "Evaluation of a Ni—20Cr Alloy Processed by Multi-axis Forging", Materials Science Forum vols. 503-504, 2006, pp. 793-798.
Disegi, J. A., "Titanium Alloys for Fracture Fixation Implants," Injury International Journal of the Care of the Injured, vol. 31 (2000) pp. S-D14-17.
Disegi, John, Wrought Titanium—15% Molybdenum Implant Material, Original Instruments and Implants of the Association for the Study of International Fixation—AO ASIF, Oct. 2003.
Donachie Jr., M.J., "Titanium A Technical Guide" 1988, ASM, pp. 39 and 46-50.
Duflou et al., "A method for force reduction in heavy duty bending", Int. J. Materials and Product Technology, vol. 32, No. 4, 2008, pp. 460-475.
Elements of Metallurgy and Engineering Alloys, Editor F. C. Campbell, ASM International, 2008, Chapter 8, p. 125.
Fedotov, S.G. et al., "Effect of Aluminum and Oxygen on the Formation of Metastable Phases in Alloys of Titanium with .beta.-Stabilizing Elements", Izvestiya Akademii Nauk SSSR, Metally (1974) pp. 121-126.
Froes, F.H. et al., "The Processing Window for Grain Size Control in Metastable Beta Titanium Alloys", Beta Titanium Alloys in the 80's, ed. By R. Boyer and H. Rosenberg, AIME, 1984, pp. 161-164.
Gigliotti et al., "Evaluation of Superplastically Roll Formed VT-25", Titamium'99, Science and Technology, 2000, pp. 1581-1588.
Gilbert et al., "Heat Treating of Titanium and Titanium Alloys-Solution Treating and Aging", ASM Handbook, 1991, ASM International, vol. 4, pp. 1-8.
Greenfield, Dan L., News Release, ATI Aerospace Presents Results of Year-Long Characterization Program for New ATI 425 Alloy Titanium Products at Aeromat 2010, Jun. 21, 2010, Pittsburgh, Pennsylvania, 1 page.
Harper, Megan Lynn, "A Study of the Microstructural and Phase Evolutions in Timetal 555", Jan. 2001, retrieved from http://www.ohiolink.edu/etd/send-pdf.cgi/harper%20megan%20lynn.pdf?acc_num=osu1132165471 on Aug. 10, 2009, 92 pages.
Hawkins, M.J. et al., "Osseointegration of a New Beta Titanium Alloy as Compared to Standard Orthopaedic Implant Metals," Sixth World Biomaterials Congress Transactions, Society for Biomaterials, 2000, p. 1083.
Ho, W.F. et al., "Structure and Properties of Cast Binary Ti—Mo Alloys" Biomaterials, vol. 20 (1999) pp. 2115-2122.
Imatani et al., "Experiment and simulation for thick-plate bending by high frequency inductor", ACTA Metallurgica Sinica, vol. 11, No. 6, Dec. 1998, pp. 449-455.
Imayev et al., "Formation of submicrocrystalline structure in TiAl intermetallic compound", Journal of Materials Science, 27, 1992, pp. 4465-4471.
Imayev et al., "Principles of Fabrication of Bulk Ultrafine-Grained and Nanostructured Materials by Multiple Isothermal Forging", Materials Science Forum, vols. 638-642, 2010, pp. 1702-1707.
Imperial Metal Industries Limited, Product Specification for "IMI Titanium 205", The Kynoch Press (England) pp. 1-5. (publication date unknown).
Jablokov et al., "Influence of Oxygen Content on the Mechanical Properties of Titanium—35Niobium—7Zirconium—5Tantalum Beta Titanium Alloy," Journal of ASTM International, Sep. 2005, vol. 2, No. 8, 2002, pp. 1-12.

(56) References Cited

OTHER PUBLICATIONS

Jablokov et al., "The Application of Ti—15 Mo Beta Titanium Alloy in High Strength Orthopaedic Applications", Journal of ASTM International, vol. 2, Issue 8 (Sep. 2005) (published online Jun. 22, 2005).
Kovtun, et al., "Method of calculating induction heating of steel sheets during thermomechanical bending", Kiev, Nikolaev, translated from Problemy Prochnosti, No. 5, pp. 105-110, May 1978, original article submitted Nov. 27, 1977, pp. 600-606.
Lampman, S., "Wrought and Titanium Alloys," ASM Handbooks Online, ASM International, 2002.
Lee et al., "An electromagnetic and thermo-mechanical analysis of high frequency induction heating for steel plate bending", Key Engineering Materials, vols. 326-328, 2006, pp. 1283-1286.
Lemons, Jack et al., "Metallic Biomaterials for Surgical Implant Devices," BONEZone, Fall (2002) p. 5-9 and Table.
Long, M. et al., "Friction and Surface Behavior of Selected Titanium Alloys During Reciprocating-Sliding Motion", Wear, 249(1-2), Jan. 17, 2001, 158-168.
Lütjering, G. and J.C. Williams, Titanium, Springer, New York (2nd ed. 2007) p. 24.
Lutjering, G. and Williams, J.C., Titanium, Springer-Verlag, 2003, Ch. 5: Alpha+Beta Alloys, p. 177-201.
Marquardt et al., "Beta Titanium Alloy Processed for High Strength Orthopaedic Applications, "Journal of ASTM International, vol. 2, Issue 9 (Oct. 2005) (published online Aug. 17, 2005).
Marquardt, Brian, "Characterization of Ti—15Mo for Orthopaedic Applications, "TMS 2005 Annual Meeting: Technical Program, San Francisco, CA, Feb. 13-17 (2005) Abstract, p. 239.
Marquardt, Brian, "Ti—15Mo Beta Titanium Alloy Processed for High Strength Orthopaedic Applications," Program and Abstracts for the Symposium on Titanium, Niobium, Zirconium, and Tantalum for Medical and Surgical Applications, Washington, D.C., Nov. 9-10, 2004 Abstract, p. 11.
Marte et al., "Structure and Properties of Ni—20CR Produced by Severe Plastic Deformation", Ultrafine Grained Materials IV, 2006, pp. 419-424.
Materials Properties Handbook: Titanium Alloys, Eds. Boyer et al, ASM International, Materials Park, OH, 1994, pp. 524-525.
Martinelli, Gianni and Roberto Peroni, "Isothermal forging of Ti-alloys for medical applications", Presented at the 11th World Conference on Titanium, Kyoto, Japan, Jun. 4-7, 2007, accessed Jun. 5, 2013, 5 pages.
McDevitt, et al., Characterization of the Mechanical Properties of ATI 425 Alloy According to the Guidelines of the Metallic Materials Properties Development & Standardization Handbook, Aeromat 2010 Conference and Exposition: Jun. 20-24, 2010, Bellevue, WA, 23 pages.
Metals Handbook, Desk Edition, 2nd ed., J. R. Davis ed., ASM International, Materials Park, Ohio (1998), pp. 575-588.
Military Standard, Fastener Test Methods, Method 13, Double Shear Test, MIL-STD-1312-13, Jul. 26, 1985, superseding MIL-STD-1312 (in part) May 31, 1967, 8 pages.
Military Standard, Fastener Test Methods, Method 13, Double Shear Test, MIL-STD-1312-13A, Aug. 23, 1991, superseding MIL-STD-13, Jul. 26, 1985, 10 pages.
Murray, J.L., et al., Binary Alloy Phase Diagrams, Second Edition, vol. 1, Ed. Massalski, Materials Park, OH; ASM International; 1990, p. 547.
Murray, J.L., The Mn—Ti (Manganese—Titanium) System, Bulletin of Alloy Phase Diagrams, vol. 2, No. 3 (1981) p. 334-343.
Myers, J., "Primary Working, A lesson from Titanium and its Alloys," ASM Course Book 27 Lesson, Test 9, Aug. 1994, pp. 3-4.
Naik, Uma M. et al., "Omega and Alpha Precipitation in Ti—15Mo Alloy,"Titanium '80 Science and Technology—Proceedings of the 4th International Conference on Titanium, H. Kimura & O. Izumi Eds. May 19-22, 1980 pp. 1335-1341.
Nguyen at al., "Analysis of bending deformation in triangle heating of steel plates with induction heating process using laminated plate theory", Mechanics Based Design of Structures and Machines, 37, 2009, pp. 228-246.
Nishimura, T. "Ti—15Mo—5Zr—3Al", Materials Properties Handbook: Titanium Alloys, eds. R. Boyer et al., ASM International, Materials Park, OH, 1994, p. 949.
Nutt, Michael J. et al., "The Application of Ti—15 Beta Titanium Alloy in High Strength Structural Orthopaedic Applications, "Program and Abstracts for the Symposium on Titanium Niobium, Zirconium, and Tantalum for Medical and Surgical Applications, Washington, D.C., Nov. 9-10, 2004 Abstract, p. 12.
Nyakana, et al., "Quick Reference Guide for β Titanium Alloys in the 00s", Journal of Materials Engineering and Performance, vol. 14, No. 6, Dec. 1, 2005, pp. 799-811.
Pennock, G.M. et al., "The Control of a Precipitation by Two Step Ageing in β Ti—15Mo," Titanium '80 Science and Technology—Proceedings of the 4th International Conference on Titanium, H. Kimura & O. Izumi Eds. May 19-22 (1980) pp. 1344-1350.
Prasad, Y.V.R.K. et al. "Hot Deformation Mechanism in Ti—6Al—4V with Transformed B Starting Microstructure: Commercial v. Extra Low Interstitial Grade", Materials Science and Technology, Sep. 2000, vol. 16, pp. 1029-1036.
Qazi, J.I. et al., "High-Strength Metastable Beta-Titanium Alloys for Biomedical Applications," JOM, Nov. 2004 pp. 49-51.
Roach, M.D., et al., "Comparison of the Corrosion Fatigue Characteristics of CPTi-Grade 4, Ti—6Al—4V ELI, Ti—6Al—7 Nb, and Ti—15 Mo", Journal of Testing and Evaluation, vol. 2, Issue 7, (Jul./Aug. 2005) (published online Jun. 8, 2005).
Roach, M.D., et al., "Physical, Metallurgical, and Mechanical Comparison of a Low-Nickel Stainless Steel," Transactions on the 27th Meeting of the Society for Biomaterials, Apr. 24-29, 2001, p. 343.
Roach, M.D., et al., "Stress Corrosion Cracking of a Low-Nickel Stainless Steel," Transactions of the 27th Annual Meeting of the Society for Biomaterials, 2001, p. 469.
Rudnev et at., "Longitudinal flux indication heating of slabs, bars and strips is no longer "Black Magic:" II", Industrial Heating, Feb. 1995, pp. 46-48 and 50-51.
Russo, P.A., "Influence of Ni and Fe on the Creep of Beta Annealed Ti—6242S", Titanium '95: Science and Technology, pp. 1075-1082.
SAE Aerospace Material Specification 4897A (issued Jan. 1997, revised Jan. 2003).
SAE Aerospace, Aerospace Material Specification, Titanium Alloy Bars, Forgings and Forging Stock, 6.0Al—4.0V Annealed, AMS 6931A, Issued Jan. 2004, Revised Feb. 2007, pp. 1-7.
SAE Aerospace, Aerospace Material Specification, Titanium Alloy Bars, Forgings and Forging Stock, 6.0Al—4.0V, Solution Heat Treated and Aged, AMS 6930A, Issued Jan. 2004, Revised Feb. 2006, pp. 1-9.
SAE Aerospace, Aerospace Material Specification, Titanium Alloy, Sheet, Strip, and Plate, 4Al—2.5V—1.5Fe, Annealed, AMS 6946A, Issued Oct. 2006, Revised Jun. 2007, pp. 1-7.
Salishchev et al., "Characterization of Submicron-grained Ti—6Al—4V Sheets with Enhanced Superplastic Properties", Materials Science Forum, Trans Tech Publications, Switzerland, vols. 447-448, 2004, pp. 441-446.
Salishchev et al., "Mechanical Properties of Ti—6Al—4V Titanium Alloy with Submicrocrystalline Structure Produced by Multiaxial Forging", Materials Science Forum, vols. 584-586, 2008, pp. 783-788.
Salishchev, et al., "Effect of Deformation Conditions on Grain Size and Microstructure Homogeneity of β-Rich Titanium Alloys", Journal of Materials Engineering and Performance, vol. 14(6), Dec. 2005, pp. 709-716.
Salishchev, G.A., "Formation of submicrocrystalline structure in large size billets and sheets out of titanium alloys", Institute for Metals Superplasticity Problems,Ufa, Russia, presented at 2003 NATO Advanced Research Workshop, Kyiv, Ukraine, Sep. 9-13, 2003, 50 pages.
Semiatin, S.L. et al., "The Thermomechanical Processing of Alpha/Beta Titanium Alloys," Journal of Metals, Jun. 1997, pp. 33-39.
Semiatin et al., "Equal Channel Angular Extrusion of Difficult-to-Work Alloys", Materials & Design, Elsevier Science Ltd., 21, 2000, pp. 311-322.
Semiatin et al., "Alpha/Beta Heat Treatment of a Titanium Alloy with a Nonuniform Microstructure", Metallurgical and Materials Transactions A, vol. 38A, Apr. 2007, pp. 910-921.

(56) References Cited

OTHER PUBLICATIONS

Shahan et al., "Adiabatic shear bands in titanium and titanium alloys: a critical review", Materials & Design, vol. 14, No. 4, 1993, pp. 243-250.
SPS Titanium™ Titanium Fasteners, SPS Technologies Aerospace Fasteners, 2003, 4 pages.
Standard Specification for Wrought Titanium—6Aluminum—4Vanadium Alloy for Surgical Implant Applications (UNS R56400), Designation: F 1472-99, ASTM 1999, pp. 1-4.
Takemoto Y et al., "Tensile Behavior and Cold Workability of Ti—Mo Alloys", Materials Transactions Japan Inst. Metals Japan, vol. 45, No. 5, May 2004, pp. 1571-1576.
Tamarisakandala, S. et al., "Strain-induced Porosity During Cogging of Extra-Low Interstitial Grade Ti—6Al—4V", Journal of Materials Engineering and Performance, vol. 10(2), Apr. 2001, pp. 125-130.
Tamirisakandala et al., "Effect of boron on the beta transus of Ti—6Al—4V alloy", Scripta Materialia, 53, 2005, pp. 217-222.
Tamirisakandala et al., "Powder Metallurgy Ti—6Al—4V—xB Alloys: Processing, Microstructure, and Properties", JOM, May 2004, pp. 60-63.
Tebbe, Patrick A. and Ghassan T. Kridli, "Warm forming aluminum alloys: an overview and future directions", Int. J. Materials and Product Technology, vol. 21, Nos. 1-3, 2004, pp. 24-40.
Technical Presentation: Overview of MMPDS Characterization of ATI 425 Alloy, 2012, 1 page.
TIMET 6-6-2 Titanium Alloy (Ti—6Al—6V—2Sn), Annealed, accessed Jun. 27, 2012.
TIMET TIMETAL® 6-2-4-2 (Ti—6Al—2Sn—4Zr—2Mo—0.085i) Titanium Alloy datasheet, accessed Jun. 26, 2012.
TIMET TIMETAL® 6-2-4-6 Titanium Alloy (Ti—6Al—2Sn—4Zr—6Mo), Typical, accessed Jun. 26, 2012.
Tokaji, Keiro et al., "The Microstructure Dependence of Fatigue Behavior in Ti—15Mo—5Zr—3Al Alloy," Materials Science and Engineering A., vol. 213 (1996) pp. 86-92.
Two new αβ titanium alloys, KS Ti-9 for sheet and KS EL-F for forging, with mechanical properties comparable to Ti—6Al—4V, Oct. 8, 2002, ITA 2002 Conference in Orlando, Hideto Oyama, Titanium Technology Dept., Kobe Steel, Ltd., 16 pages.
Veeck, S., et al., "The Castability of Ti-5553 Alloy," Advanced Materials and Processes, Oct. 2004, pp. 47-49.
Weiss, I. et al., "The Processing Window Concept of Beta Titanium Alloys", Recrystallization '90, ed. by T. Chandra, The Minerals, Metals & Materials Society, 1990, pp. 609-616.
Weiss, I. et al., "Thermomechanical Processing of Beta Titanium Alloys—An Overview," Material Science and Engineering, A243, 1998, pp. 46-65.
Williams, J., Thermo-mechanical processing of high-performance Ti alloys: recent progress and future needs, Journal of Material Processing Technology, 117 (2001), p. 370-373.
Zardiackas, L.D. et al., "Stress Corrosion Cracking Resistance of Titanium Implant Materials," Transactions of the 27th Annual Meeting of the Society for Biomaterials, (2001).
Zeng et al., Evaluation of Newly Developed Ti-555 High Strength Titanium Fasteners, 17th AeroMat Conference & Exposition, May 18, 2006, 2 pages.
Zhang et al., "Simulation of slip band evolution in duplex Ti—6Al—4V", Acta Materialia, vol. 58, (2010), Nov. 26, 2009, pp. 1087-1096.
Zherebtsov et al., "Production of submicrocrystalline structure in large-scale Ti—6Al—4V billet by warm severe deformation processing", Scripta Materialia, 51, 2004, pp. 1147-1151.
Titanium Alloy, Sheet, Strip, and Plate 4Al—2.5V—1.5Fe, Annealed, AMS6946 Rev. B, Aug. 2010, SAE Aerospace, Aerospace Material Specification, 7 pages.
Titanium Alloy, Sheet, Strip, and Plate 6Al—4V, Annealed, AMS 4911L, Jun. 2007, SAE Aerospace, Aerospace Material Specification, 7 pages.
Office Action mailed Oct. 19, 2011 in U.S. Appl. No. 12/691,952.
Office Action mailed Feb. 2, 2012 in U.S. Appl. No. 12/691,952.
Office Action mailed Feb. 20, 2004 in U.S. Appl. No. 10/165,348.
Office Action mailed Oct. 26, 2004 in U.S. Appl. No. 10/165,348.
Office Action mailed Feb. 16, 2005 in U.S. Appl. No. 10/165,348.
Office Action mailed Jul. 25, 2005 in U.S. Appl. No. 10/165,348.
Office Action mailed Jan. 3, 2006 in U.S. Appl. No. 10/165,348.
Office Action mailed Dec. 16, 2004 in U.S. Appl. No. 10/434,598.
Office Action mailed Aug. 17, 2005 in U.S. Appl. No. 10/434,598.
Office Action mailed Dec. 19, 2005 in U.S. Appl. No. 10/434,598.
Office Action mailed Sep. 6, 2006 in U.S. Appl. No. 10/434,598.
Office Action mailed Aug. 6, 2008 in U.S. Appl. No. 11/448,160.
Office Action mailed Jan. 13, 2009 in U.S. Appl. No. 11/448,160.
Notice of Allowance mailed Apr. 13, 2010 in U.S. Appl. No. 11/448,160.
Notice of Allowance mailed Sep. 20, 2010 in U.S. Appl. No. 11/448,160.
Office Action mailed Sep. 26, 2007 in U.S. Appl. No. 11/057,614.
Office Action mailed Jan. 10, 2008 in U.S. Appl. No. 11/057,614.
Office Action mailed Aug. 29, 2008 in U.S. Appl. No. 11/057,614.
Office Action mailed Aug. 11, 2009 in U.S. Appl. No. 11/057,614.
Office Action mailed Jan. 14, 2010 in U.S. Appl. No. 11/057,614.
Interview summary mailed Apr. 14, 2010 in U.S. Appl. No. 11/057,614.
Office Action mailed Jun. 21, 2010 in U.S. Appl. No. 11/057,614.
Notice of Allowance mailed Sep. 3, 2010 in U.S. Appl. No. 11/057,614.
Office Action mailed Apr. 1, 2010 in U.S. Appl. No. 11/745,189.
Interview summary mailed Jun. 3, 2010 in U.S. Appl. No. 11/745,189.
Interview summary mailed Jun. 15, 2010 in U.S. Appl. No. 11/745,189.
Office Action mailed Nov. 24, 2010 in U.S. Appl. No. 11/745,189.
Interview summary mailed Jan. 6, 2011 in U.S. Appl. No. 11/745,189.
Notice of Allowance mailed Jun. 27, 2011 in U.S. Appl. No. 11/745,189.
Office Action mailed Jan. 11, 2011 in U.S. Appl. No. 12/911,947.
Office Action mailed Aug. 4, 2011 in U.S. Appl. No. 12/911,947.
Office Action mailed Nov. 16, 2011 in U.S. Appl. No. 12/911,947.
Advisory Action mailed Jan. 25, 2012 in U.S. Appl. No. 12/911,947.
Notice of Panel Decision from Pre-Appeal Brief Review mailed Mar. 28, 2012 in U.S. Appl. No. 12/911,947.
Office Action mailed Apr. 5, 2012 in U.S. Appl. No. 12/911,947.
Office Action mailed Sep. 19, 2012 in U.S. Appl. No. 12/911,947.
Advisory Action mailed Nov. 29, 2012 in U.S. Appl. No. 12/911,947.
Office Action mailed May 31, 2013 in U.S. Appl. No. 12/911,947.
Office Action mailed Jan. 3, 2011 in U.S. Appl. No. 12/857,789.
Office Action mailed Jul. 27, 2011 in U.S. Appl. No. 12/857,789.
Advisory Action mailed Oct. 7, 2011 in U.S. Appl. No. 12/857,789.
Notice of Allowance mailed Jul. 1, 2013 in U.S. Appl. No. 12/857,789.
Office Action mailed Nov. 14, 2012 in U.S. Appl. No. 12/885,620.
Office Action mailed Jun. 13, 2013 in U.S. Appl. No. 12/885,620.
Office Action mailed Nov. 14, 2012 in U.S. Appl. No. 12/888,699.
Office Action mailed Oct. 3, 2012 in U.S. Appl. No. 12/838,674.
Office Action mailed Jul. 18, 2013 in U.S. Appl. No. 12/838,674.
Office Action mailed Sep. 26, 2012 in U.S. Appl. No. 12/845,122.
Notice of Allowance mailed Apr. 17, 2013 in U.S. Appl. No. 12/845,122.
Office Action mailed Dec. 24, 2012 in U.S. Appl. No. 13/230,046.
Notice of Allowance mailed Jul. 31, 2013 in U.S. Appl. No. 13/230,046.
Office Action mailed Dec. 26, 2012 in U.S. Appl. No. 13/230,143.
Notice of Allowance mailed Aug. 2, 2013 in U.S. Appl. No. 13/230,143.
Office Action mailed Mar. 1, 2013 in U.S. Appl. No. 12/903,851.
Office Action mailed Mar. 25, 2013 in U.S. Appl. No. 13/108,045.
Office Action mailed Apr. 16, 2013 in U.S. Appl. No. 13/150,494.
Office Action mailed Jun. 14, 2013 in U.S. Appl. No. 13/150,494.
U.S. Appl. No. 13/777,066, filed Feb. 26, 2013.
U.S. Appl. No. 13/331,135, filed Dec. 20, 2011.
U.S. Appl. No. 13/792,285, filed Mar. 11, 2013.
U.S. Appl. No. 13/844,196, filed Mar. 15, 2013.
Office Action mailed Jan. 23, 2013 in U.S. Appl. No. 12/882,538.
Office Action mailed Feb. 8, 2013 in U.S. Appl. No. 12/882,538.

(56) References Cited

OTHER PUBLICATIONS

Notice of Allowance mailed Jun. 24, 2013 in U.S. Appl. No. 12/882,538.
Notice of Allowance mailed Oct. 4, 2013 in U.S. Appl. No. 12/911,947.
Notice of Allowance mailed Nov. 5, 2013 in U.S. Appl. No. 13/150,494.
U.S. Appl. No. 13/933,222, filed Mar. 15, 2013.
Office Action mailed Sep. 6, 2013 in U.S. Appl. No. 13/933,222.
Notice of Allowance mailed Oct. 1, 2013 in U.S. Appl. No. 13/933,222.
U.S. Appl. No. 14/077,699, filed Nov. 12, 2013.
E112-12 Standard Test Methods for Determining Average Grain Size, ASTM International, Jan. 2013, 27 pages.
ATI Datalloy 2 Alloy, Technical Data Sheet, ATI Properties, Inc., Version 1, Jan. 24, 2013, 6 pages.
ATI AL-6XN® Alloy (UNS N08367), ATI Allegheny Ludlum, 2010, 59 pages.
ATI 800™/ATI 800H™/ATI 800AT™ ATI Technical Data Sheet, Nickel-base Alloys (UNS N08800/N08810/N08811), 2012 Allegheny Technologies Incorporated, Version 1, Mar. 9, 2012, 7 pages.
ATI 825™ Technical Data Sheet, Nickel-base Alloy (UNS N08825), 2013 Allegheny Technologies Incorporated, Version 2, Mar. 8, 2013, 5 pages.
ATI 625™ Alloy Technical Data Sheet, High Strength Nickel-base Alloy (UNS N06625), Allegheny Technologies Incorporated, Version 1, Mar. 4, 2012, 3 pages.
ATI 600™ Technical Data Sheet, Nickel-base Alloy (UNS N06600), 2012 Allegheny Technologies Incorporated, Version 1, Mar. 19, 2012, 5 pages.
Office Action mailed Nov. 19, 2013 in U.S. Appl. No. 12/885,620.
ASTM Designation F 2066/F2066M-13, "Standard Specification for Wrought Titanium-15 Molybdenum Alloy for Surgical Implant Applications (UNS R58150)", Nov. 2013, 6 pages.
Boyko et al., "Modeling of the Open-Die and Radial Forging Processes for Alloy 718", Superalloys 718, 625 and Various Derivatives: Proceedings of the International Symposium on the Metallurgy and Applications of Superalloys 718, 625 and Various Derivatives, held Jun. 23, 1992, pp. 107-124.
Advisory Action Before the Filing of an Appeal Brief mailed Jan. 30, 2014 in U.S. Appl. No. 12/885,620.
Office Action mailed Jun. 18, 2014 in U.S. Appl. No. 12/885,620.
Office Action mailed Jan. 16, 2014 in U.S. Appl. No. 12/903,851.
Office Action mailed Jan. 17, 2014 in U.S. Appl. No. 13/108,045.
Supplemental Notice of Allowability mailed Jan. 17, 2014 in U.S. Appl. No. 13/150,494.
Notice of Allowance mailed May 6, 2014 in U.S. Appl. No. 13/933,222.
Beal et al., "Forming of Titanium and Titanium Alloys-Cold Forming", ASM Handbook, 2006, ASM International, Revised by ASM Committee on Forming Titanium Alloys, vol. 14B, 2 pages.
Bar definition, ASM Materials Engineering Dictionary, J.R. Davis Ed., ASM International, Materials Park, OH (1992) p. 32.
Billet definition, ASM Materials Engineering Dictionary, J.R. Davis Ed., ASM International, Materials Park, OH (1992) p. 40.
Cogging definition, ASM Materials Engineering Dictionary, J.R. Davis Ed., ASM International, Materials Park, OH (1992) p. 79.
Open die press forging definition, ASM Materials Engineering Dictionary, J.R. Davis Ed., ASM International, Materials Park, OH (1992) pp. 298 and 343.
Thermomechanical working definition, ASM Materials Engineering Dictionary, J.R. Davis Ed., ASM International, Materials Park, OH (1992) p. 480.
Ductility definition, ASM Materials Engineering Dictionary, J.R. Davis Ed., ASM International, Materials Park, OH (1992) p. 131.
Office Action mailed Dec. 23, 2014 in U.S. Appl. No. 12/691,952.
Office Action mailed Nov. 28, 2014 in U.S. Appl. No. 12/885,620.
Office Action mailed Oct. 6, 2014 in U.S. Appl. No. 12/903,851.
Office Action mailed Jan. 21, 2015 in U.S. Appl. No. 13/792,285.

* cited by examiner

Repeat upset/draw cycles as desired for further microstructure refinement

336

SPLIT-PASS OPEN-DIE FORGING FOR HARD-TO-FORGE, STRAIN-PATH SENSITIVE TITANIUM-BASE AND NICKEL-BASE ALLOYS

STATEMENT REGARDING FEDERALLY SPONSORED RESEARCH OR DEVELOPMENT

This invention was made with United States government support under NIST Contract Number 70NANB7H7038, awarded by the National Institute of Standards and Technology (NIST), United States Department of Commerce. The United States government may have certain rights in the invention.

BACKGROUND OF THE TECHNOLOGY

1. Field of the Technology

The present disclosure relates to methods of forging metal alloys, including metal alloys that are difficult to forge due to low ductility. Certain methods according to the present disclosure impart strain in a way that maximizes the buildup of disorientation into the metal grain crystal structure and/or second-phase particles, while minimizing the risk of initiation and propagation of cracks in the material being forged. Certain methods according to the present disclosure are expected to affect microstructure refinement in the metal alloys.

2. Description of the Background of the Technology

Ductility is an inherent property of any given metallic material (i.e., metals and metal alloys). During a forging process, the ductility of a metallic material is modulated by the forging temperature and the microstructure of the metallic material. When ductility is low, for example, because the metallic material has inherently low ductility, or a low forging temperature must be used, or a ductile microstructure has not yet been generated in the metallic material, it is usual practice to reduce that amount of reduction during each forge iteration. For example, instead of forging a 22 inch octagonal workpiece to a 20 inch octagon directly, a person ordinarily skilled in the art may consider initially forging to a 21 inch octagon with forging passes on each face of the octagon, reheating the workpiece, and forging to a 20 inch octagon with forging passes on each face of the octagon. This approach, however, may not be suitable if the metal exhibits strain-path sensitivity and a specific final microstructure is to be obtained in the product. Strain-path sensitivity can be observed when a critical amount of strain must be imparted at given steps to trigger grain refinement mechanisms. Microstructure refinement may not be realized by a forge practice in which the reductions taken during draws are too light.

In a situation where the metallic material is low temperature sensitive and is prone to cracking at low temperatures, the on-die time must be reduced. A method to accomplish this, for example, is to forge a 22 inch octagonal billet to a 20 inch round cornered square billet (RCS) using only half of the passes that would be required to forge a 20 inch octagonal billet. The 20 inch RCS billet may then be reheated and the second half of passes applied to form a 20 inch octagonal billet. Another solution for forging low temperature sensitive metallic materials is to forge one end of the workpiece first, reheat the workpiece, and then forge the other end of the workpiece.

In dual phase microstructures, microstructure refinement starts with sub-boundary generation and disorientation buildup as a precursor to processes such as, for example, nucleation, recrystallization, and/or second phase globularization. An example of an alloy that requires disorientation build up for refinement of microstructure is Ti-6Al-4V alloy (UNS R56400) forged in the alpha-beta phase field. In such alloys, forging is more efficient in terms of microstructure refinement when a large reduction is imparted in a given direction before the workpiece is rotated. This can be done on a laboratory scale using multi-axis forging (MAF). MAF performed on small pieces (a few inches per side) in (near-) isothermal conditions and using very low strain rates with proper lubrication is able to impart strain rather homogeneously; but departure from any of these conditions (small scale, near-isothermal, with lubrication) may result in heterogeneous strain imparted preferentially to the center as well as ductility issues with cold surface cracking. An MAF process for use in industrial scale grain refinement of titanium alloys is disclosed in U.S. Patent Publication No. 2012/0060981 A1, which is incorporated by reference herein in its entirety.

It would be desirable to develop a method of working that provides sufficient strain to a metallic material to initiate microstructure refinement mechanisms efficiently through forging, while limiting ductility issues.

SUMMARY

According to a non-limiting aspect of the present disclosure, a method of forging a metallic material workpiece comprises open die press forging the workpiece at a forging temperature in a first forging direction up to a reduction ductility limit of the metallic material. Open die press forging the workpiece up to the reduction ductility limit of the metallic material is repeated one or more times at the forging temperature in the first forging direction until a total amount of strain imparted in the first forging direction is sufficient to initiate microstructure refinement. The workpiece is then rotated a desired degree of rotation.

The rotated workpiece is open die press forged at the forging temperature in a second forging direction up to the reduction ductility limit of the metallic material. Open die press forging the workpiece up to the ductility limit of the metallic material is repeated one or more times at the forging temperature in the second forging direction until a total amount of strain imparted in the second forging direction is sufficient to initiate microstructure refinement.

The steps of rotating, open die press forging, and repeating open die press forging are repeated in a third forging and, optionally, one or more additional directions until a total amount of strain to initiate grain refinement is imparted in the entire volume of the workpiece. The workpiece is not rotated until a total amount of strain that is sufficient to initiate microstructure refinement is imparted in each of the third and one or more additional directions.

According to another non-limiting embodiment of the present disclosure, a method of split pass open die forging a metallic material workpiece to initiate microstructure refinement comprises providing a hybrid octagon-RCS workpiece comprising a metallic material. The workpiece is upset forged. The workpiece is subsequently rotated for open die drawing on a first diagonal face in an X' direction of the hybrid octagon-RCS workpiece. The workpiece is multiple pass draw forged in the X' direction to the strain threshold for microstructure refinement initiation. Each multiple pass draw forging step comprises at least two open press draw forging steps with reductions up to the reduction ductility limit of the metallic material.

The workpiece is rotated for open die drawing on a second diagonal face in a Y' direction of the hybrid octagon-RCS workpiece. The workpiece is multiple pass draw forged in the Y' direction to the strain threshold for microstructure refinement initiation. Each multiple pass draw forging step comprises at least two open press draw forging steps with reductions up to the reduction ductility limit of the metallic material.

The workpiece is rotated for open die drawing on a first RCS face in a Y direction of the hybrid octagon-RCS workpiece. The workpiece is multiple pass draw forged in the Y direction to the strain threshold for microstructure refinement initiation. Each multiple pass draw forging step comprises at least two open press draw forging steps with reductions up to the reduction ductility limit of the metallic material.

The workpiece is rotated for open die drawing on a second RCS face in an X direction of the hybrid octagon-RCS workpiece. The workpiece is multiple pass draw forged in the X direction to the strain threshold for grain refinement initiation. Each multiple pass draw forging step comprises at least two open press draw forging steps with reductions up to the reduction ductility limit of the metallic material The steps of upsetting and multiple draw forging cycles can be repeated as desired to further initiate and or enhance microstructure refinement in the metallic material.

BRIEF DESCRIPTION OF THE DRAWINGS

The features and advantages of the methods and articles described herein may be better understood by reference to the accompanying drawings in which.

Figure 1:
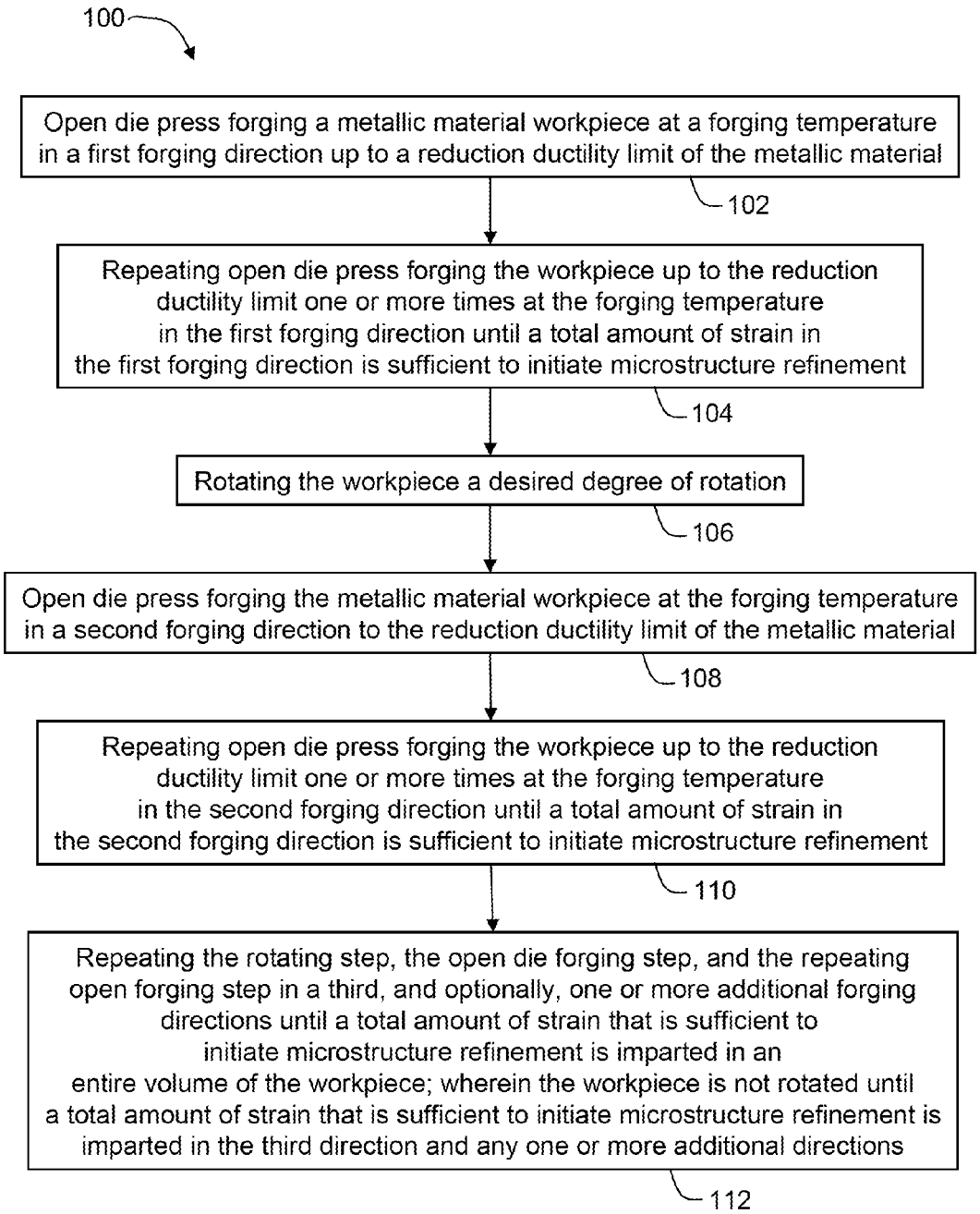
FIG. 1 is a flow diagram of a non-limiting embodiment of a method of split-pass open die forging a metallic material according to the present disclosure.

The reader will appreciate the foregoing details, as well as others, upon considering the following detailed description of certain non-limiting embodiments according to the present disclosure.

DETAILED DESCRIPTION OF CERTAIN NON-LIMITING EMBODIMENTS

It is to be understood that certain descriptions of the embodiments described herein have been simplified to illustrate only those elements, features, and aspects that are relevant to a clear understanding of the disclosed embodiments, while eliminating, for purposes of clarity, other elements, features, and aspects. Persons having ordinary skill in the art, upon considering the present description of the disclosed embodiments, will recognize that other elements and/or features may be desirable in a particular implementation or application of the disclosed embodiments. However, because such other elements and/or features may be readily ascertained and implemented by persons having ordinary skill in the art upon considering the present description of the disclosed embodiments, and are therefore not necessary for a complete understanding of the disclosed embodiments, a description of such elements and/or features is not provided herein. As such, it is to be understood that the description set forth herein is merely exemplary and illustrative of the disclosed embodiments and is not intended to limit the scope of the invention as defined solely by the claims.

Any numerical range recited herein is intended to include all sub-ranges subsumed therein. For example, a range of "1 to 10" or "from 1 to 10" is intended to include all sub-ranges between (and including) the recited minimum value of 1 and the recited maximum value of 10, that is, having a minimum value equal to or greater than 1 and a maximum value of equal to or less than 10. Any maximum numerical limitation recited herein is intended to include all lower numerical limitations subsumed therein and any minimum numerical limitation recited herein is intended to include all higher numerical limitations subsumed therein. Accordingly, Applicants reserve the right to amend the present disclosure, including the claims, to expressly recite any sub-range subsumed within the ranges expressly recited herein. All such ranges are intended to be inherently disclosed herein such that amending to expressly recite any such sub-ranges would comply with the requirements of 35 U.S.C. §112, first paragraph, and 35 U.S.C. §132(a).

The grammatical articles "one", "a", "an", and "the", as used herein, are intended to include "at least one" or "one or more", unless otherwise indicated. Thus, the articles are used herein to refer to one or more than one (i.e., to at least one) of the grammatical objects of the article. By way of example, "a component" means one or more components, and thus, possibly, more than one component is contemplated and may be employed or used in an implementation of the described embodiments.

All percentages and ratios are calculated based on the total weight of the particular metallic material composition, unless otherwise indicated.

Any patent, publication, or other disclosure material that is said to be incorporated, in whole or in part, by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The present disclosure includes descriptions of various embodiments. It is to be understood that all embodiments described herein are exemplary, illustrative, and non-limiting. Thus, the invention is not limited by the description of the various exemplary, illustrative, and non-limiting embodiments. Rather, the invention is defined solely by the claims, which may be amended to recite any features expressly or inherently described in or otherwise expressly or inherently supported by the present disclosure.

As used herein, the term "metallic material" refers to metals, such as commercially pure metals, and metal alloys.

As used herein, the terms "cogging", "forging", and "open die press forging" refer to forms of thermomechanical processing ("TMP"), which also may be referred to herein as "thermomechanical working". "Thermomechanical working" is defined herein as generally covering a variety of metallic material forming processes combining controlled thermal and deformation treatments to obtain synergistic effects, such as, for example, and without limitation, improvement in strength, without loss of toughness. This definition of thermomechanical working is consistent with the meaning ascribed in, for example, ASM Materials Engineering Dictionary, J. R. Davis, ed., ASM International (1992), p. 480. As used herein, the term "open die press forging" refers to the forging of metallic material between dies, in which the material flow is not completely restricted, by mechanical or hydraulic pressure, accompanied with a single work stroke of the press for each die session. This definition of open die press forging is consistent with the meaning ascribed in, for example, ASM Materials Engineering Dictionary, J. R. Davis, ed., ASM International (1992), pp. 298 and 343. As used herein, the term "cogging" refers to a thermomechanical reducing process used to improve or refine the grains of a metallic material, while working an ingot into a billet. This definition of cogging is consistent with the meaning ascribed in, for example, ASM Materials Engineering Dictionary, J. R. Davis, ed., ASM International (1992), p. 79.

As used herein, the term "billet" refers to a solid semifinished round or square product that has been hot worked by forging, rolling, or extrusion. This definition of billet is consistent with the meaning ascribed in, for example, ASM Materials Engineering Dictionary, J. R. Davis, ed., ASM International (1992), p. 40. As used herein, the term "bar" refers to a solid section forged from a billet to a form, such as round, hexagonal, octagonal, square, or rectangular, with sharp or rounded edges, and is long in relationship to its cross-sectional dimensions, having a symmetrical cross-section. This definition of bar is consistent with the meaning ascribed in, for example, ASM Materials Engineering Dictionary, J. R. Davis, ed., ASM International (1992), p. 32.

As used herein, the term "ductility limit" refers to the limit or maximum amount of reduction or plastic deformation a metallic material can withstand without fracturing or cracking. This definition is consistent with the meaning ascribed in, for example, ASM Materials Engineering Dictionary, J. R. Davis, ed., ASM International (1992), p 131. As used herein, the term "reduction ductility limit" refers to the amount or degree of reduction that a metallic material can withstand before cracking or fracturing.

As used herein, the phrases "initiate microstructure refinement" and "strain threshold for microstructure refinement initiation" refer to imparting strain in the microstructure of a metallic material to produce a buildup of disorientation (e.g., dislocations and sub-boundaries) in the crystal structure and/or second phase particles that results in a reduction of the material's grain size. Strain is imparted to metallic materials during the practice of non-limiting embodiments of methods of the present disclosure, or during subsequent thermomechanical processing steps. In substantially single-phase nickel-base or titanium-base alloys (at least 90% of $\gamma$ phase in nickel or $\beta$ phase in titanium) the strain threshold for microstructure refinement initiation refers to the nucleation of the first recrystallized grains. It can be estimated from a stress-strain curve measured at the temperature and strain rates of interest through uniaxial compression or tension. It is usually in the order of 0.1 to 0.3 strain. When dual phase nickel-base and titanium-base alloys are forged, microstructure evolution is far more sluggish. For instance, the globularization of the secondary phase may not be achieved or even initiated in a single draw. The focus is then placed on the strain required to build up disorientation efficiently throughout the accumulation of multiple forging steps. Microstructure refinement refers then to the formation of small sub-grains increasingly disoriented from their parent grain or original orientation. This is tied to dynamic recovery (accumulation of dislocations into sub-boundaries), the effect of which can also be seen on stress-strain curves in the form of flow softening. Similar threshold values of 0.1 to 0.3 are usually obtained and may be used as a qualitative estimate of strain threshold that needs to be reached at every draw or forge operation. Promoting disorientation build up during a draw increases the probability that sub-grains will disorient even more after rotation for the next draw instead of bringing their orientation back to that of their parent grain.

According to an aspect of a method of split pass open die forging according to the present disclosure, split pass open die forging relies on precisely controlling the amount of strain imparted to the workpiece at every pass to limit cracking of the workpiece. If insufficient reduction is taken in a given forging direction to initiate the microstructure refinement process in that given direction, open die press forging is repeated on the same face, in the same direction, up to the reduction ductility limit of the metallic material being forged, until sufficient reduction has been imparted in that direction to initiate microstructure refinement.

If the desirable amount of reduction to be imparted to a workpiece at any pass to initiate microstructure refinement exceeds the maximum amount of reduction that can be taken in one draw forging pass without too much material cracking, i.e., the amount of reduction exceeds the material's reduction ductility limit, then the reduction pass should be split into two or more passes so that 1) the strain imparted in any pass is less than the reduction ductility limit of the material at the forging temperature, and 2) the total strain imparted in one forging direction is sufficient to initiate satisfactory microstructure refinement. Only after imparting sufficient strain to drive microstructure evolution and initiate microstructure refinement in the one direction should the workpiece be rotated for forging for the next reduction pass, in a second direction.

Referring to FIG. 1, according to one non-limiting aspect of the present disclosure a method 100 of forging a metallic material workpiece to initiate microstructure refinement comprises open die press forging 102 the metallic material workpiece at a forging temperature in a first forging direction up to a reduction ductility limit of the metallic material. The reduction ductility limit of the metallic material, as the phrase is used herein, can be estimated qualitatively by the fracture strain ($\epsilon_f$), which is the engineering strain at which a test specimen fractures during a uniaxial tensile test. One particular uniaxial tensile test that may be used is described in ASTM E8/E8M-11, "Standard Test Methods for Tension Testing of Metallic Materials", ASTM International, West Conshohocken, Pa., USA (2011). The true fracture strain $\epsilon_f$ is the true strain based on the original area $A_0$ and the area after fracture $A_f$, and is given by the Equation (1). A person ordinarily skilled in the art may readily estimate the reduction ductility limit for a particular metallic material from Equation (1) and, therefore, reduction ductility limits for specific metallic materials need to be included herein.

$$\epsilon_f = \ln(A_0/A_f) \qquad \text{Equation (1):}$$

After open die press forging 102 the metallic material workpiece at a forging temperature in a first forging direction up to a reduction ductility limit of the metallic material, the workpiece is open die press forged up to the reduction ductility limit of the metallic material 104 one or more times at the forging temperature in the first forging direction until a total amount of strain in the first forging direction is sufficient to initiate microstructure refinement. The workpiece is then rotated 106 a desired degree of rotation in preparation for the next forging pass.

It will be recognized that a desired degree of rotation is determined by the geometry of the workpiece. For example, a workpiece in the shape of an octagonal cylinder may be forged on any face, then rotated 90° and forged, then rotated 45° and forged, and then rotated 90° and forged. To eliminate swelling of sides of the octagonal cylinder, the octagonal cylinder may be planished by rotating 45° and planishing, then rotating 90° and planishing, then rotating 45° and planishing, and then rotating 90° and planishing. As will be understood by those having ordinary skill, the term "planish" and its forms, as used herein, refer to smoothing, planning, or finishing a surface of a metallic material workpiece by applying light open-die press forging strokes to surfaces of the metallic workpiece to bring the workpiece (e.g., a billet or bar) to the desired configuration and dimensions. An ordinarily skilled practitioner may readily determine the desired degree of rotations for workpieces having any particular cross-sectional shapes, such as, for example, round, square, or rectangular cross-sectional shapes.

After rotating 106 the metallic material workpiece a desired degree of rotation, the workpiece is open die press forged 108 at the forging temperature in a second forging direction to the reduction ductility limit of the metallic material. Open die press forging of the workpiece is repeated 110 up to the reduction ductility limit one or more times at the forging temperature in the second forging direction until a total amount of strain in the second forging direction is sufficient to initiate microstructure refinement in the metallic material.

Steps of rotating, open die forging, and repeating open die forging are repeated 112 in a third and, optionally, one or more additional directions until all faces have been forged to a size such that a total amount of strain that is sufficient to initiate microstructure refinement is imparted in the entire volume, or throughout the workpiece. For each of third and one or more additional directions in which microstructure refinement needs to be activated at that point in the process, open die press forging is repeated up to the reduction ductility limit and the workpiece is not rotated until a sufficient amount of strain is imparted in that specific direction. And for each of the third and one or more additional directions in which only shape control or planish is needed, open die press forging is performed only up to the reduction ductility limit. An ordinarily skilled practitioner, on reading the present description, may readily determine the desired degrees of rotation and the number of forging directions required for working a specific workpiece geometry using the methods described herein.

Embodiments of methods according to the present disclosure differ from, for example, working methods applying strain to form a slab from workpiece having a round or octagonal cross-section. For example, instead of continuing working to provide a flat product, edging only to control width, in non-limiting embodiments according to the present disclosure similar repeated passes are taken on additional sides of the workpiece to maintain a somewhat isotropic shape, that does not deviate substantially from the target final shape, which may be, for example, a rectangular, square, round, or octagonal billet or bar.

In cases when large redundant strain must be imparted, the drawing method according to the present disclosure can be combined with upsets. Multiple upsets and draws rely on repeating a pattern of recurring shapes and sizes. A particular embodiment of the invention involves a hybrid of an octagon and an RCS cross-section that aims to maximize the strain imparted on two axes during the draws, alternating the directions of the faces and diagonals at every upset-and-draw cycle. This non-limiting embodiment emulates the way in which strain is imparted in cube-like MAF samples, while allowing scale-up to industrial sizes.

Figure 2:
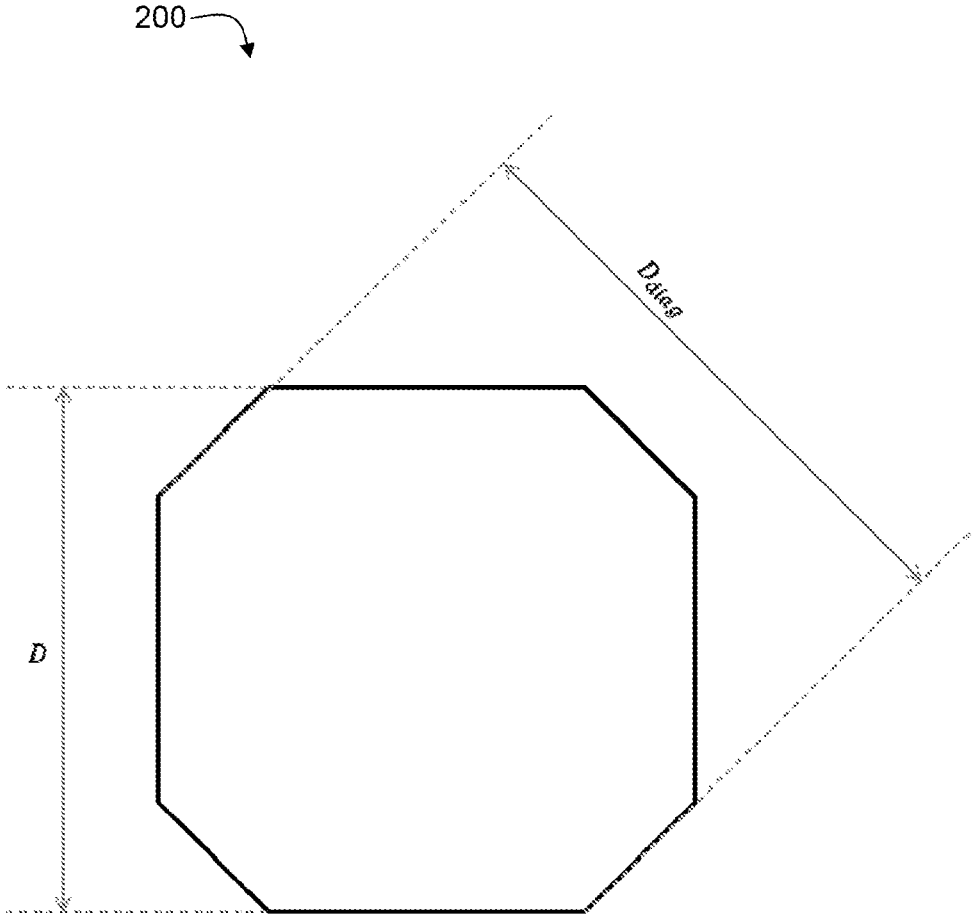
FIG. 2 is a schematic representation of a hybrid octagon-RCS workpiece according to a non-limiting embodiment of the present disclosure.

Accordingly, as shown in FIG. 2, in a non-limiting embodiment of a method of upset forging and draw forging according to the present disclosure, the special cross-section shape 200 of a billet is a hybrid of an octagon and an RCS, herein referred to as a hybrid octagon-RCS shape. In a non-limiting embodiment, each draw forging step results in this recurring hybrid octagon-RCS shape prior to a new upset. In order to facilitate upsetting, the workpiece length may be less than three times the minimum face-to-face size of the hybrid octagon-RCS. A key parameter in this hybrid shape is the ratio of sizes between, on the one hand, the 0° and 90° faces of the RCS (arrow labeled D in FIG. 2) and, on the other hand, the diagonal faces at 45° and 135° (arrow labeled $D_{diag}$ in FIG. 2) which make it look somewhat like an octagon. In a non-limiting embodiment, this ratio may be set in relation to the upset reduction such that the size of the 45°/135° diagonals ($D_{diag}$) before upset is about the same as the size of the 0°/90° (D) diagonals after upset.

In one non-limiting exemplary calculation of the hybrid octagon-RCS shape, an upset reduction of U (or as a percentage (100X U)) is considered. After an upset forging of U reduction, the diagonal size becomes:

$$\frac{D_{diag}}{\sqrt{1-U}} = \frac{\beta D}{\sqrt{1-U}}.$$

Then, the reduction from new diagonal to face is defined as R, and:

$$1-R = \frac{D}{\frac{\beta D}{\sqrt{1-U}}} = \frac{\sqrt{1-U}}{\beta}.$$

Rearranging gives:

$$\beta = \frac{\sqrt{1-U}}{1-R}.$$

After upset, the size between the main faces is:

$$\frac{D}{\sqrt{1-U}}.$$

So the reduction on faces to become the new diagonal is:

$$r = 1 - \frac{D_{diag}}{\frac{D}{\sqrt{1-U}}} = 1 - \beta\sqrt{1-U} = 1 - \frac{1-U}{1-R}.$$

This implies that for reduction r to be defined (positive), U must be greater than or equal to R. In the case where U=R, in theory, no work would be needed on the faces to become the new diagonals. In practice, however, forging will result in some swell in the faces, and forging will be needed.

Using these equations, a non-limiting embodiment according to the present disclosure considers the situation in which D=24 inch, U=26%, and R=25%.

This gives:

$$\beta = \frac{\sqrt{0.74}}{0.75} \sim 1.147.$$

Then the diagonal dimension is:

$$D_{diag} = \beta D \sim 1.147 \times 24'' \sim 27.5'',$$

and:

$$r = 1 - \frac{0.74}{0.75} \sim 1.3\%.$$

However, part of the reduction work on the diagonals swells onto the faces, so the reduction put to form and control the size of the new diagonals actually must be greater than 1.3%. The forging schedule needed to control the faces is simply defined as a few passes to limit swelling and control the size of new diagonals.

Figure 3A:
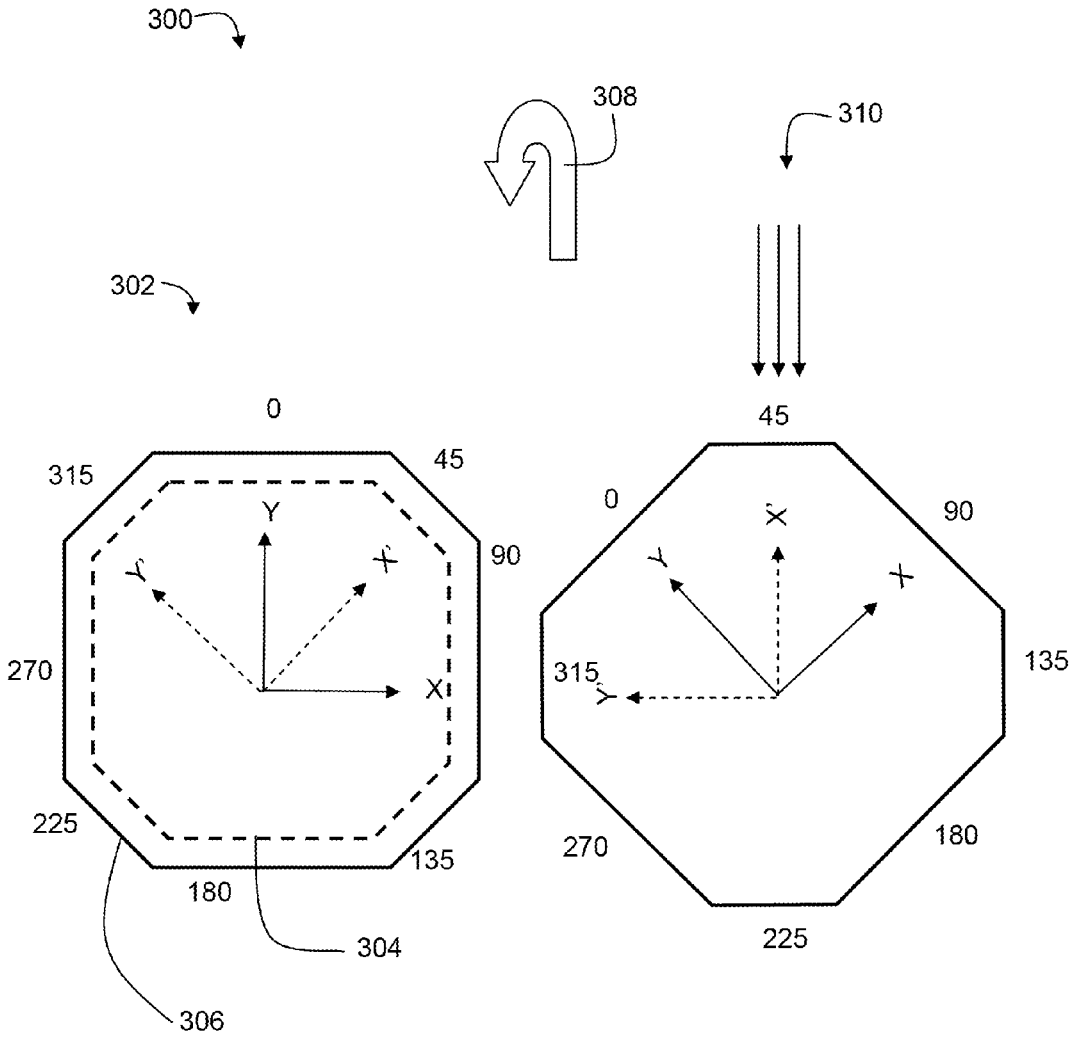
FIG. 3A through FIG. 3E are schematic illustrations of a non-limiting embodiment of a method of split-pass open die forging a metallic material hybrid octagon-RCS workpiece according to the present disclosure.

A non-limiting example of split pass open die forging 300 is schematically illustrated in FIG. 3A through FIG. 3E. Referring to FIG. 3A, a hybrid octagon-RCS workpiece comprising a hard to forge metallic material is provided and open die upset forged 302. The dimensions of the workpiece prior to upset forging are illustrated by the dashed lines 304, and the dimensions of the workpiece after upset forging are illustrated by the solid line 306. The faces representing the initial RCS portion of the hybrid octagon-RCS workpiece are labeled in FIGS. 3A-E as 0, 90, 180, and 270. The Y-direction of the workpiece is in the direction that is perpendicular to the 0 and 180 degree faces. The X-direction of the workpiece is in the direction perpendicular to the 90 and 270 degree faces. The faces representing the initial diagonal octagon portions of the hybrid octagon-RCS workpiece are labeled in FIGS. 3A-E as 45, 135, 225, and 315. The diagonal X' direction of the workpiece is in the direction perpendicular to the 45 and 225 degree faces. The diagonal Y' direction of the workpiece is in the direction perpendicular to the 135 and 315 degree faces.

After upset forging, the workpiece is rotated (arrow 308) for open die drawing on a first diagonal face (X' direction), and specifically in the present embodiment is rotated (arrow 308) to the 45 degree diagonal face for draw forging. The workpiece is then multiple pass draw forged (arrow 310) on the diagonal face to the strain threshold for microstructure refinement initiation without passing the reduction ductility limit. Each multiple pass draw forging step comprises at least two open press draw forging steps with reductions up to the reduction ductility limit of the metallic material.

Figure 3B:
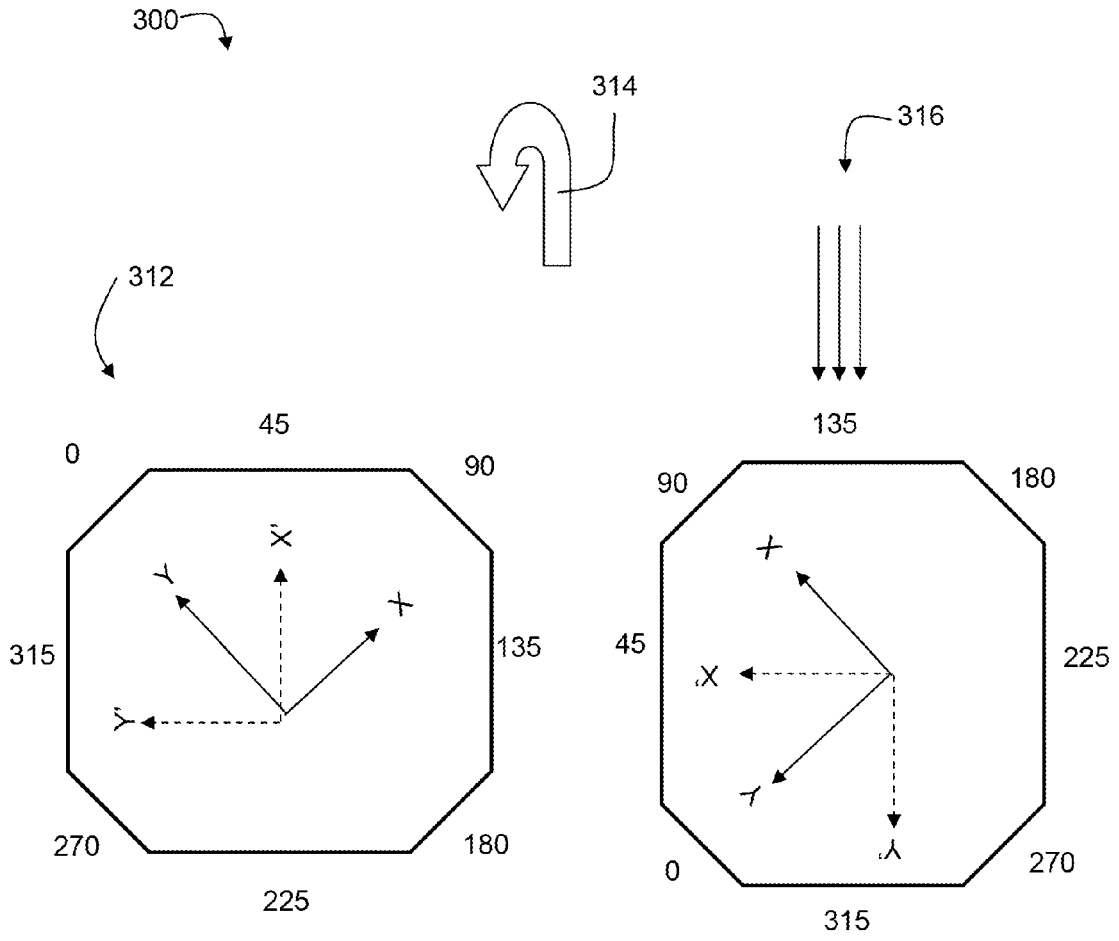

Referring to FIG. 3B, the workpiece after multiple pass draw forging on the 45 degree diagonal face is depicted by reference number 312 (not drawn to scale). The workpiece is rotated 90 degrees (arrow 314), in this specific embodiment, to the 135 second diagonal face (Y' direction) for multiple pass draw forging 316. The workpiece is then multiple pass draw forged (arrow 316) on the diagonal face to the strain threshold for microstructure refinement initiation. Each multiple pass draw forging step comprises at least two open press draw forging steps with reductions up to the reduction ductility limit of the metallic material.

Figure 3C:
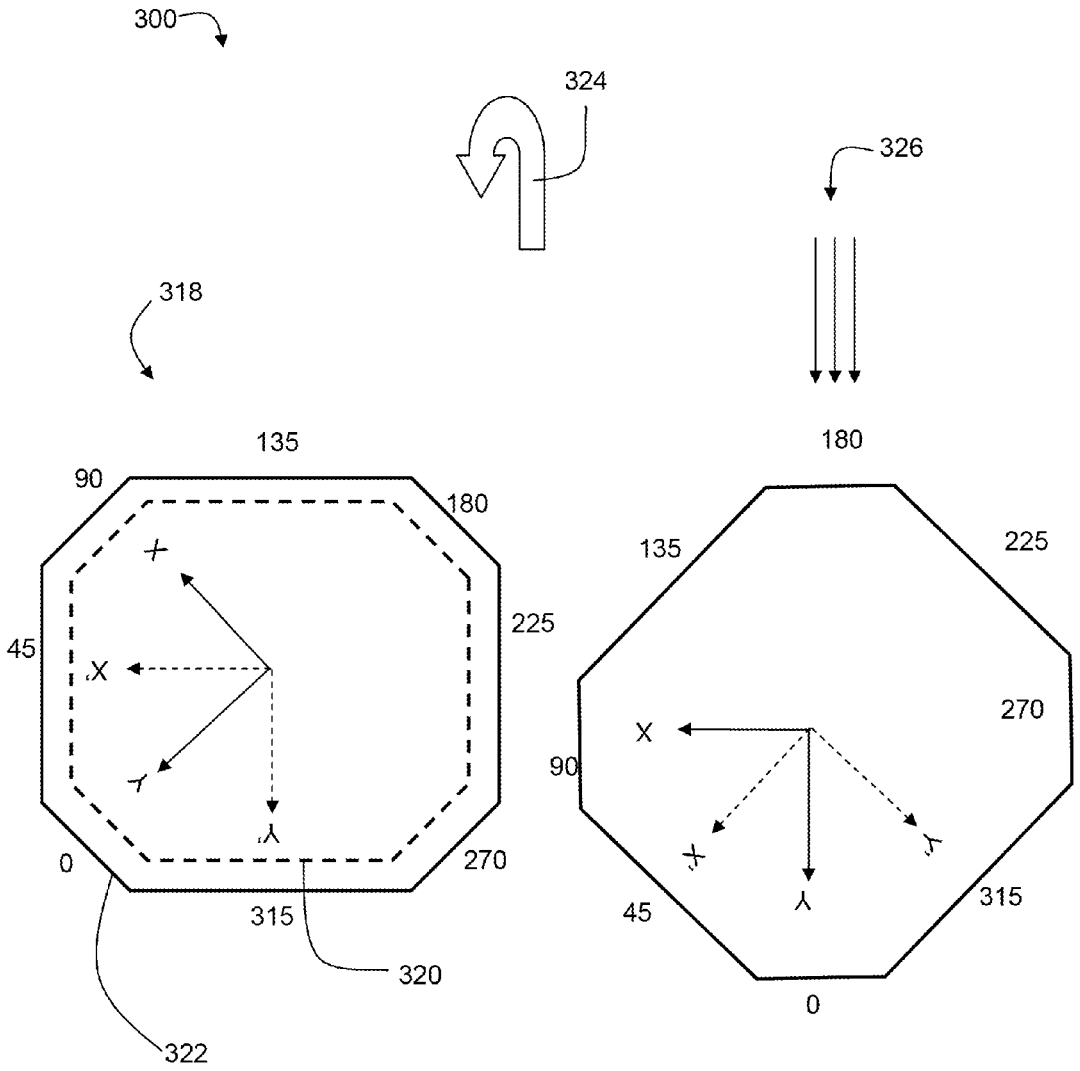

Referring to FIG. 3C, in a non-limiting embodiment, the workpiece is upset forged 318. The dimensions of the workpiece prior to upset forging are illustrated by the dashed lines 320, and the dimensions of the workpiece after upset forging are illustrated by the solid lines 322.

After upset forging, the workpiece is rotated (arrow 324) for open die drawing on a first RCS face, and specifically in the present embodiment is rotated (arrow 324) to the 180 degree diagonal face (first RCS face; Y direction) for draw forging. The workpiece is then multiple pass draw forged (arrow 326) on the first RCS face to the strain threshold for microstructure refinement initiation. Each multiple pass draw forging step comprises at least two open press draw forging steps with reductions up to the reduction ductility limit of the metallic material.

Figure 3D:
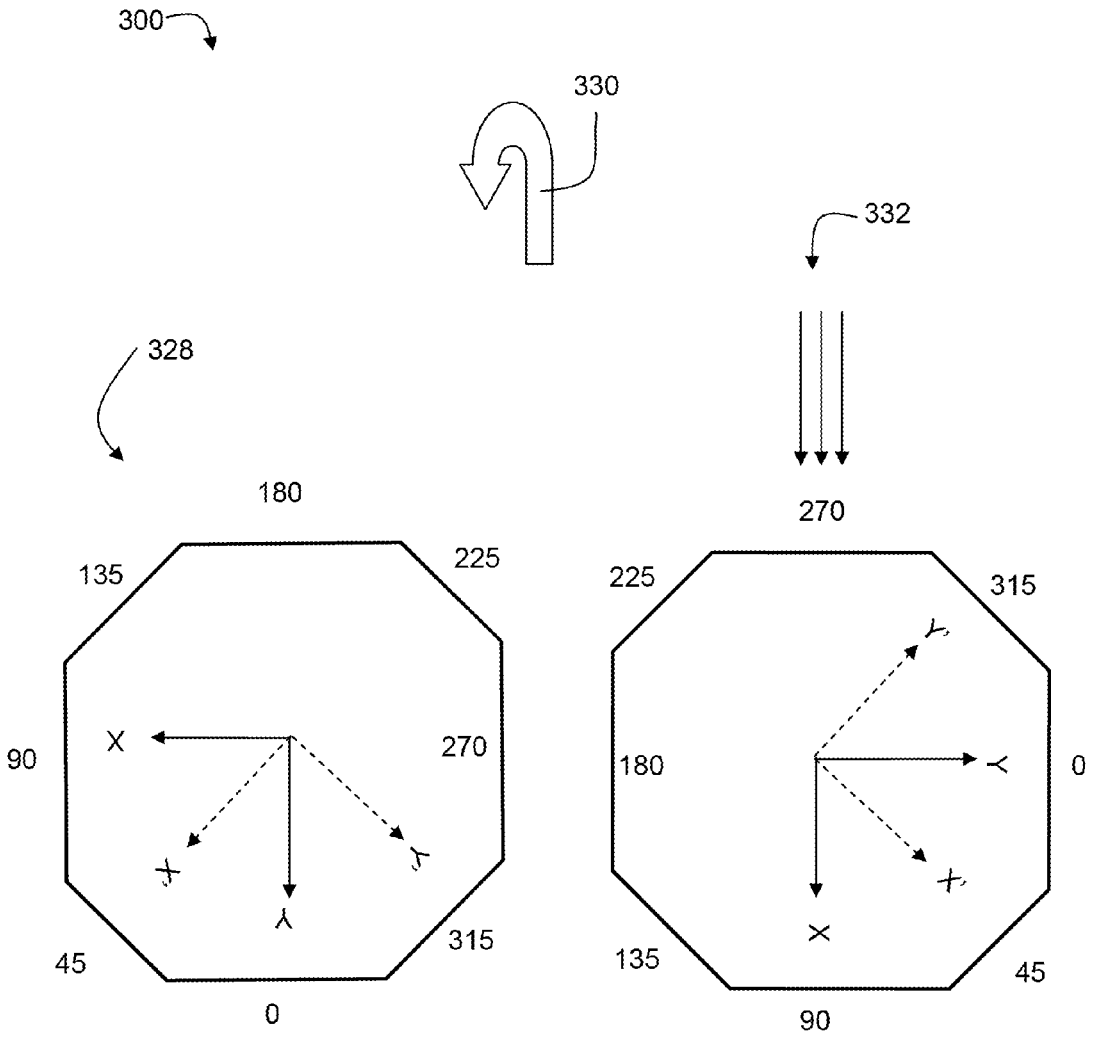

Referring to FIG. 3D, the workpiece after multiple pass draw forging on the 180 degree face is depicted by reference number 328 (not drawn to scale). The workpiece is rotated 90 degrees (arrow 330), in this specific embodiment, to the 270 degree second RCS face (X direction) for multiple pass draw forging 332. The workpiece is then multiple pass draw forged (arrow 322) on the second RCS face to the strain threshold for microstructure refinement initiation. Each multiple pass draw forging step comprises at least two open press draw forging steps with reductions up to the reduction ductility limit of the metallic material.

Figure 3E:
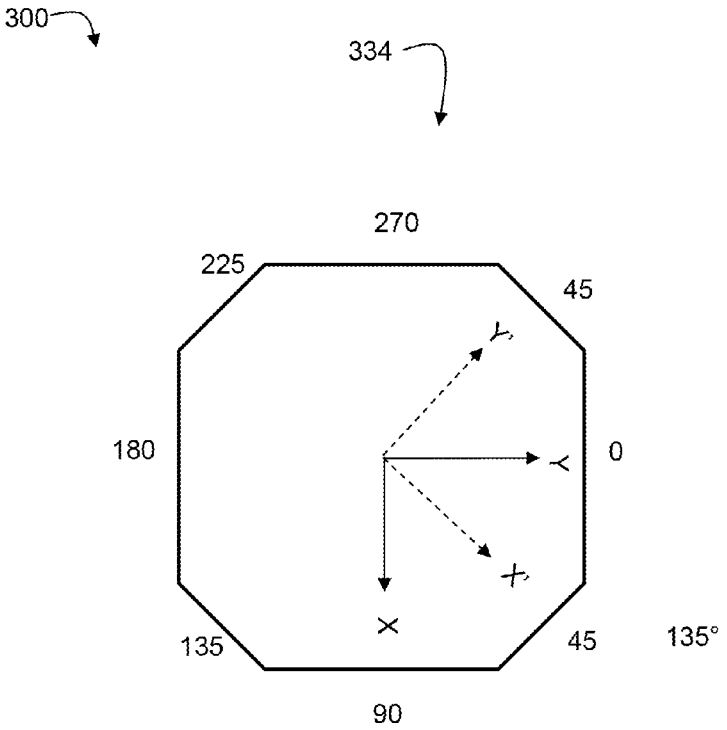

Referring to FIG. 3E, the hybrid octagon-RCS workpiece 334 forged according to the non-limiting embodiment described herein above is seen to have substantially the same dimensions as the original hybrid octagon-RCS workpiece. The final forged workpiece comprises a grain refined microstructure. This is result of (1) the upsets, which constitute reductions along the Z-axis of the workpiece, followed by multiple draws on the X' (reference number 312), Y' (reference number 316), Y (reference number 326), and X axes (reference number 332); (2) the fact that each pass of the multiple draw was to the reduction ductility limit; and (3) the fact that the multiple draws on each axis provided a total strain up to the strain threshold required for microstructure refinement. In a non-limiting embodiment according to the present disclosure, upset forging comprises open die press forging to a reduction in length that is less than the ductility limit of the metallic material, and the forging imparts sufficient strain to initiate microstructure refinement in the upset forging direction. Usually, the upset will be imparted in just one reduction because upsets are typically performed at slower strain rates at which the ductility limit itself tends to be greater than at the higher strain rates used during draws. But it may be split in two or more reductions with an intermediate reheat if the reduction exceeds the ductility limit.

It is known that Vee dies naturally create significant lateral swell on the first pass of a reduction. A non-limiting embodiment of a split pass method includes after a 90° rotation, the reduction is made to the original size first, and only then takes the reduction. For example, going form 20 inch to 16 inch with a maximum pass of 2 inch, one may take a reduction to 18 inch on the first side, then rotate 90° and take a reduction to 20 inch to control the swell, then take another reduction on the same side to 18 inch, and then again another reduction to 16 inch. The workpiece is rotate 90° and a reduction to 18 inch is made to control the swell, and then a new reduction to 16 inch. The workpiece is rotated 90° and a reduction to 18 inch is taken to control the swell, and then again to 16 inch as a new reduction. At that pint a couple of rotations associated with planish and passes to 16 inch should complete a process that insures that no more than a 2 inch reduction is taken at any pass.

According to an aspect of the present disclosure, the metallic material processed according to non-limiting embodiments herein comprises one of a titanium alloy and a nickel alloy. In certain non-limiting embodiments, the metallic material comprises a nickel-base superalloy, such as, for example, one of Waspaloy® (UNS N07001), ATI 718Plus® alloy (UNS N07818), and Alloy 720 (UNS N07720). In certain non-limiting embodiments, the metallic material comprises a titanium alloy, or one of an alpha-beta titanium alloy and a metastable-beta titanium alloy. In non-limiting embodiments, an alpha-beta titanium alloy processed by embodiments of the methods disclosed herein comprises one of a Ti-6Al-4V alloy (UNS R56400), a Ti-6Al-4V ELI alloy (UNS R56401), a Ti-6Al-2Sn-4Zr-6Mo alloy (UNS R56260), a Ti-6Al-2Sn-4Zr-2Mo alloy (UNS R54620), a Ti-10V-2Fe-3Al alloy (AMS 4986) and a Ti-4Al-2.5V-1.5Fe alloy (UNS 54250).

In a non-limiting embodiment according to the split pass forging methods of the present disclosure, open die press forging comprises forging at a forging temperature that is within a temperature range spanning 1100° F. up to a temperature 50° F. below a beta-transus temperature of the alpha-beta titanium alloy. In another non-limiting embodiment, a method according to present disclosure further comprises one of reheating or annealing the workpiece intermediate any open die press forging steps.

It will be recognized that it is within the scope of the methods of the present disclosure to reheat the workpiece intermediate any open pass press forging steps. It will also be recognized that it is within the scope of the methods of the present disclosure to anneal the workpiece intermediate any open pass press forging steps. The specific details of reheating and annealing a metallic material are known or readily ascertainable to ordinarily skilled practitioners and therefore need not be specified herein.

The examples that follow are intended to further describe certain non-limiting embodiments, without restricting the scope of the present invention. Persons having ordinary skill in the art will appreciate that variations of the following examples are possible within the scope of the invention, which is defined solely by the claims.

Example 1

A 24 inch octagonal billet comprising Ti-4Al-2.5V-1.5Fe alloy is heated to a forging temperature of 1600° F. A reduction ductility limit of the alloy at the forging temperature is estimated to be at least 2 inches per reduction and would not tolerate much more reduction in a repeated fashion without extensive cracking to be 2 inches per reduction. The billet is open die press forged in a first direction, on any face of the octagonal billet, to 22 inches. The billet is then open die press forged in the first direction to 20 inches. The billet is rotated 90° to a second direction for open die press forging. While the original octagonal billet dimension was 24 inches, due to swelling of alternate faces during forging in the first direction, the billet is open die press forged in the second direction to 24 inches. The billet is then open die press forged in the second direction two more times to 22 inches, and then to 20 inches. The billet is reheated to the forging temperature. The billet is rotated 45° and then is split pass forged 2 inches per reduction in the third forging direction to 24 inches, then to 22 inches, and then to 20 inches. The billet is rotated 90° and then is split pass forged 2 inches per reduction in another forging direction, according to the present disclosure, to 24 inches, then to 22 inches then to 20 inches.

The billet is next planished by the following steps: rotating the billet 45° and squaring the side to 20 inches using open die press forging; rotating the billet 90° and squaring the side to 20 inches using open die press forging; rotating the billet 45° and squaring the side to 20 inches using open die press forging; and rotating the billet 90° and squaring the side to 20 inches using open die press forging. This method ensures that no single pass imparts a change in dimension of more than 2 inches, which is the reduction ductility limit, while every total reduction in each desired direction is at least 4 inches, which corresponds to the strain threshold required to initiate microstructure refinement in the microstructure of the alloy.

As part of a sequence of multiple upsets and draws, the split pass die forging method of the present Example, the microstructure of the Ti-4Al-2.5V-1.5Fe alloy is comprised of globularized, or equiaxed, alpha-phase particles having an average grain size in the range of 1 μm to 5 μm.

Example 2

A hybrid octagon-RCS billet of a metallic material comprising Ti-6Al-4V alloy is provided. The hybrid octagon-RCS shape is a 24 inch RCS with 27.5 inch diagonals forming an octagon. The length is defined to be no more than 3×24 inches or 72 inches, and in this example the billet is 70 inches in length. In order to initiate microstructure refinement, the billet is upset forged at 1600° F. to a 26 percent reduction. After the upset reduction, the billet is about 51 inches long and its hybrid octagon-RCS cross-section is about 27.9 inch× 32 inch. The billet is to be draw forged by a reduction of the 32 inch diagonals back to 24 inch faces, which is an 8 inch reduction, or 25% of the diagonal height. In doing so, it is expected that the other diagonal would swell beyond 32 inch. In the present example, a reasonable estimate for the reduction ductility limit at a forging temperature in the range of 1600° F. is that no pass should exceed a 2.5 inch reduction. Because reductions from 32 inch to 24 inch on diagonals could not be imparted at once in open die press forging given that this exceeds the reduction ductility limit of the material, the split-pass method according to the present disclosure was employed for this specific non-limiting embodiment.

In order to forge the old diagonals down to being the new faces, the 32 inch high face is open press forged to 29.5 inch, and then open press forged to 27.0 inch. The hybrid octagon-RCS billet is rotated 90°, open die press forged to 30.5 inch, and then open die press forged to 28 inch. The hybrid octagon-RCS billet is then forged on the old faces to control the new diagonal size. The hybrid octagon-RCS billet is rotated 45° and open die press forged to 27 inch; and then rotated 90° and open die press forged to 27.25 inch. The hybrid octagon-RCS billet is open die press forged on the old diagonals so that they become the new faces by rotating the hybrid octagon-RCS billet by 45° and open die press forging to 25.5 inch, followed by open die press forging the same face to 23.25 inch. The hybrid octagon-RCS billet is rotated 90° and press forged to 28 inch, then open die press forged to 25.5 inch in another split pass, and then open die press forged to 23.25 in a further split pass on the same face. The hybrid octagon-RCS billet is rotated 90° and open die press forged to 24 inch, and then rotated 90° and forged to 24 inch. Finally, the new diagonals of the hybrid octagon-RCS billet are planished by rotating the hybrid octagon-RCS billet 45° and open die press forged to 27.25 inch, followed by rotating the hybrid octagon-RCS billet 90° and open die press forging to 27.5 inch.

As part of a sequence of multiple upsets and draws the split pass die forging method of the present Example, the microstructure of the Ti-6Al-4V alloy is comprised of globularized, or equiaxed, alpha-phase particles having an average grain size in the range of 1 μm to 5 μm.

It will be understood that the present description illustrates those aspects of the invention relevant to a clear understanding of the invention. Certain aspects that would be apparent to those of ordinary skill in the art and that, therefore, would not facilitate a better understanding of the invention have not been presented in order to simplify the present description. Although only a limited number of embodiments of the present invention are necessarily described herein, one of ordinary skill in the art will, upon considering the foregoing description, recognize that many modifications and variations of the invention may be employed. All such variations and modifications of the invention are intended to be covered by the foregoing description and the following claims.

What is claimed is:

1. A method of forging a metallic material workpiece to initiate microstructure refinement, the method comprising:

open die press forging the workpiece at a forging temperature in a first forging direction up to a reduction ductility limit of the metallic material;

repeating open die press forging the workpiece in the first forging direction up to the reduction ductility limit one or more times at the forging temperature until a total amount of strain imparted in the first forging direction is sufficient to initiate microstructure refinement;

rotating the workpiece a desired degree of rotation;

open die press forging the workpiece at the forging temperature in a second forging direction up to the reduction ductility limit of the metallic material;

repeating open die press forging the workpiece in the second forging direction up to the reduction ductility limit one or more times at the forging temperature until a total amount of strain imparted in the second forging direction is sufficient to initiate microstructure refinement; and repeating the rotating step, the open die press forging step, and the repeating open die press forging step in a third and, optionally, one or more additional forging directions until a total amount of strain that is sufficient to initiate microstructure refinement is imparted in an entire volume of the workpiece, wherein the workpiece is not rotated until a total amount of strain that is sufficient to initiate microstructure refinement is imparted in the third direction and any one or more additional directions.

2. The method according to claim 1, wherein the metallic material comprises one of a titanium alloy and a nickel alloy.

3. The method according to claim 1, wherein the metallic material comprises a titanium alloy.

4. The method according to claim 3, wherein the titanium alloy comprises one of a Ti-6Al-4V alloy (UNS R56400), a Ti-6Al-4V ELI alloy (UNS R56401), a Ti-6Al-2Sn-4Zr-6Mo alloy (UNS R56260), a Ti-6Al-2Sn-4Zr-2Mo alloy (UNS R54620), a Ti-10V-2Fe-3Al alloy (AMS 4986) and a Ti-4Al-2.5V-1.5Fe alloy (UNS 54250).

5. The method according to claim 3, wherein the metallic material comprises one of an alpha-beta titanium alloy and a metastable-beta titanium alloy.

6. The method according to claim 3, wherein the metallic material comprises an alpha-beta titanium alloy.

7. The method according to claim 6, wherein the alpha-beta titanium alloy comprises a Ti-4Al-2.5V-1.5Fe alloy (UNS 54250).

8. The method according to claim 2, wherein the metallic material comprises one of a of Waspaloy® (UNS N07001), ATI 718Plus® alloy (UNS N07818), and Alloy 720 (UNS N07720).

9. The method according to claim 1, wherein the forging temperature is within a temperature range spanning 1100° F. up to a temperature 50° F. below a beta-transus temperature of the alpha-beta titanium alloy.

10. The method according to claim 1, further comprising reheating the workpiece intermediate any open die press forging steps.

11. The method according to claim 1, further comprising annealing the workpiece intermediate any open die press forging steps.

12. A method of split pass open die forging a metallic material workpiece to initiate microstructure refinement, comprising:

providing a hybrid octagon-RCS workpiece comprising a metallic material;

open die upset forging the workpiece;

rotating the workpiece for open die drawing on a first diagonal face in an X' direction of the hybrid octagon-RCS workpiece;

multiple pass draw forging the workpiece in the X' direction to the strain threshold for microstructure refinement initiation;

wherein each multiple pass draw forging step comprises at least two open press draw forging steps with reductions up to the reduction ductility limit of the metallic material;

rotating the workpiece for open die drawing on a second diagonal face in an Y' direction of the hybrid octagon-RCS workpiece;

multiple pass draw forging the workpiece in the Y' direction to the strain threshold for microstructure refinement initiation;

wherein each multiple pass draw forging step comprises at least two open press draw forging steps with reductions up to the reduction ductility limit of the metallic material;

rotating the workpiece for open die drawing on a first RCS face in an Y direction of the hybrid octagon-RCS workpiece;

multiple pass draw forging the workpiece in the Y direction to the strain threshold for microstructure refinement initiation;

wherein each multiple pass draw forging step comprises at least two open press draw forging steps with reductions up to the reduction ductility limit of the metallic material;

rotating the workpiece for open die drawing on a second RCS face in an X direction of the hybrid octagon-RCS workpiece;

multiple pass draw forging the workpiece in the X direction to the strain threshold for microstructure refinement initiation;

wherein each multiple pass draw forging step comprises at least two open press draw forging steps with reductions up to the reduction ductility limit of the metallic material;

repeating the upset and multiple draw cycles as desired.

13. The method according to claim 12, wherein the metallic material comprises one of a titanium alloy and a nickel alloy.

14. The method according to claim 12, wherein the metallic material comprises a titanium alloy.

15. The method according to claim 14, wherein the titanium alloy comprises one of a Ti-6Al-4V alloy (UNS R56400), a Ti-6Al-4V ELI alloy (UNS R56401), a Ti-6Al-2Sn-4Zr-6Mo alloy (UNS R56260), a Ti-6Al-2Sn-4Zr-2Mo alloy (UNS R54620), a Ti-10V-2Fe-3Al alloy (AMS 4986) and a Ti-4Al-2.5V-1.5Fe alloy (UNS 54250).

16. The method according to claim 14, wherein the metallic material comprises one of an alpha-beta titanium alloy and a metastable-beta titanium alloy.

17. The method according to claim 14, wherein the metallic material comprises an alpha-beta titanium alloy.

18. The method according to claim 17, wherein the alpha-beta titanium alloy comprises a Ti-4Al-2.5V-1.5Fe alloy (UNS 54250).

19. The method according to claim 13, wherein the metallic material comprises one of a of Waspaloy® (UNS N07001), ATI 718Plus® alloy (UNS N07818), and Alloy 720 (UNS N07720).

20. The method according to claim 12, wherein the forging temperature is within a temperature range spanning 1100° F. up to a temperature 50° F. below a beta-transus temperature of the alpha-beta titanium alloy.

21. The method according to claim 12, further comprising reheating the workpiece intermediate any open die press forging steps.

22. The method according to claim 12, further comprising annealing the workpiece intermediate any open die press forging steps.

* * * * *